US012123637B2

(12) United States Patent
Kim

(10) Patent No.: US 12,123,637 B2
(45) Date of Patent: Oct. 22, 2024

(54) REFRIGERATOR

(71) Applicant: LG Electronics Inc., Seoul (KR)

(72) Inventor: Wan Hee Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 98 days.

(21) Appl. No.: 17/348,370

(22) Filed: Jun. 15, 2021

(65) Prior Publication Data

US 2022/0011037 A1 Jan. 13, 2022

(30) Foreign Application Priority Data

Jul. 10, 2020 (KR) ..... 10-2020-0085333

(51) Int. Cl.
*F25D 17/08* (2006.01)
*F25D 17/06* (2006.01)

(52) U.S. Cl.
CPC ..... *F25D 17/08* (2013.01); *F25D 17/067* (2013.01); *F25D 2317/0671* (2013.01); *F25D 2323/0024* (2013.01)

(58) Field of Classification Search
CPC ..... F25D 17/08; F25D 17/067; F25D 2317/0671; F25D 2323/0024; F25D 2317/0651; F25D 2317/0665; F25D 11/00; F25D 17/062; F25D 2317/041; F25D 2317/067; F25D 2317/0681
See application file for complete search history.

(56) References Cited

U.S. PATENT DOCUMENTS 3,893,307 A * 7/1975 Jacobs ..... F25D 17/065 62/150
5,819,552 A * 10/1998 Lee ..... F25D 17/065 62/407
2006/0248915 A1 11/2006 Lee
2009/0113920 A1 5/2009 Bae et al.
2011/0162403 A1* 7/2011 Selin et al. ..... F25D 17/062 62/264
2017/0198961 A1* 1/2017 Jung ..... F25B 39/00
2017/0284724 A1* 10/2017 Lee et al. ..... F25B 5/02
2018/0120016 A1* 5/2018 Maxwell et al. . F25D 2317/067
(Continued)

FOREIGN PATENT DOCUMENTS

CN 109990564 7/2019
EP 3249325 4/2020
(Continued)

OTHER PUBLICATIONS

Office Action in Australian Application No. 2021204082, dated May 11, 2022, 4 pages.
(Continued)

*Primary Examiner* — Elizabeth J Martin
*Assistant Examiner* — Dario Antonio Deleon
(74) *Attorney, Agent, or Firm* — Fish & Richardson P.C.

(57) ABSTRACT

A refrigerator includes a blower fan assembly having a cold air introduction hole configured to be open toward a storage compartment, and the blower fan assembly is located behind the front surface of an evaporator. Due to the structure of the refrigerator, cold air passing through the evaporator may efficiently flow to the cold air introduction hole of the blower fan assembly, and the flow resistance of the cold air may be reduced, so consumption efficiency may be improved.

17 Claims, 24 Drawing Sheets

(56) References Cited

U.S. PATENT DOCUMENTS

| | | | | |
|---|---|---|---|---|
| 2018/0172336 | A1 | 6/2018 | Bae et al. | |
| 2019/0032989 | A1 | 1/2019 | Kim et al. | |
| 2019/0056165 | A1* | 2/2019 | Im et al. | F25D 17/062 |
| 2020/0033046 | A1* | 1/2020 | Song et al. | F25D 17/062 |
| 2020/0309443 | A1* | 10/2020 | Marinello et al. | F25D 17/08 |
| 2022/0163250 | A1* | 5/2022 | Wang et al. | F25D 17/067 |

FOREIGN PATENT DOCUMENTS

| | | |
|---|---|---|
| EP | 3936796 | 1/2022 |
| FR | 2586289 | 2/1987 |
| KR | 1020190010340 | 1/2019 |
| KR | 1020190010341 | 1/2019 |
| KR | 1020190019428 | 2/2019 |
| KR | 20190121437 A | 10/2019 |
| WO | WO2009062911 | 5/2009 |

OTHER PUBLICATIONS

Extended European Search Report in European Appln. No. 21180699.7, dated Nov. 23, 2021, 8 pages.

Office Action in European Appln. No. 21180699.7, mailed on Jun. 2, 2023, 5 pages.

* cited by examiner

REFRIGERATOR

CROSS REFERENCE TO RELATED APPLICATION

The present application claims priority to Korean Patent Application No. 10-2020-0085333, filed on Jul. 10, 2020, the entire contents of which are incorporated herein for all purposes by this reference.

TECHNICAL FIELD

The present disclosure relates to a refrigerator which is configured to have one storage compartment and to keep goods stored in the storage compartment at low temperature.

BACKGROUND

Generally, a refrigerator is a household appliance which stores various foods or beverages for a long time with cold air produced by circulation of refrigerant according to a refrigeration cycle.

Such a refrigerator may be divided into a refrigerator which can commonly store goods irrespective of the kinds of the goods such as food or beverages to be stored, and each dedicated refrigerator having a structure or function different from each other according to the kinds of goods to be stored.

Recently, a dedicated refrigerator which has one storage compartment and performs freezing or refrigerating operation for the storage compartment has been provided.

That is, one storage compartment may be operated (refrigeration or freezing operation) by the operation of the refrigeration cycle including a compressor, a condenser, and an evaporator.

Particularly, the dedicated refrigerator may be divided into a refrigerator for refrigerating stored goods and a refrigerator for freezing stored goods.

Accordingly, a user may use one of the refrigerator for freezing and the refrigerator for refrigeration, or may use the refrigerator for freezing and the refrigerator for refrigeration which are placed side by side, or may use a plurality of refrigerators for freezing or a plurality of refrigerators for refrigeration which are placed side by side. Accordingly, the dedicated refrigerator may be variously used according to the needs of a user.

The dedicated refrigerator described above may include the type of refrigerators disclosed in Korean Patent Application Publication No. 10-2019-0010340, Korean Patent Application Publication No. 10-2019-0010341, and Korean Patent Application Publication No. 10-2019-0019428.

However, in the conventional dedicated refrigerator described above, a machine room is built-in under a casing. Accordingly, the entire height of the refrigerator is required to be increased as much as the height of the machine room, and the refrigerator has storage space smaller than a refrigerator having the same height.

In addition, in the conventional dedicated refrigerator described above, the machine room is configured such that external air is introduced to the opposite wall surfaces of a portion at which the machine room is located. Accordingly, when the refrigerator is not built-in, but is installed indoor, the structure of the portion to which the air is introduced is exposed to the outside, which deteriorates the beauty of the refrigerator.

Furthermore, in the conventional dedicated refrigerator described above, cold air to be introduced to a blower fan assembly through the evaporator may not sufficiently pass through the evaporator and some of the cold air may deviate from the evaporator. Due to this, the cooling efficiency of the evaporator is inevitably low.

SUMMARY

Accordingly, the present disclosure has been made keeping in mind the above problems occurring in the related art, and the present disclosure is intended to propose a new type of refrigerator which may be provided as an indoor-installed structure as well as a built-in structure to further secure storage space in the refrigerator.

Furthermore, the present disclosure is intended to propose a new type of refrigerator in which the structures of a machine room and a refrigeration cycle related to the machine room may be improved such that cold air stably flows.

In addition, the present disclosure is intended to propose a new type of refrigerator in which cold air passing through an evaporator by the operation of a blower fan may sufficiently pass through the entire portion of the evaporator such that cooling efficiency by the evaporator may be improved.

In order to achieve the above objectives, in the refrigerator of the present disclosure, a cold air introduction hole of a blower fan assembly may be located behind the front surface of the front surface of an evaporator. Accordingly, the flow of cold air may be efficiently performed.

In addition, in the refrigerator of the present disclosure, a first duct assembly may be included in a storage compartment. Accordingly, cold air blown by the blower fan assembly may be supplied into the storage compartment.

Furthermore, in the refrigerator of the present disclosure, a second duct assembly may be included in the storage compartment. Accordingly, cold air passing through the evaporator may be guided to flow to the blower fan assembly.

Additionally, in the refrigerator of the present disclosure, the second duct assembly may be coupled to the first duct assembly. Accordingly, any one duct assembly of the first duct assembly and the second duct assembly may be decoupled from the remaining duct assembly.

In addition, in the refrigerator of the present disclosure, a support part may be formed at the lower end of the first duct assembly by protruding downward therefrom. Accordingly, the first duct assembly may support the upper end of the second duct assembly.

Furthermore, in the refrigerator of the present disclosure, a restraining protrusion may be formed at the rear surface of the second duct assembly. Accordingly, the second duct assembly may be held and restrained on the rear surface of the support part of the first duct assembly.

Additionally, in the refrigerator of the present disclosure, a receiving groove may be formed at the first duct assembly by being recessed therefrom. Accordingly, when the upper end of the second duct assembly is inserted to the receiving groove, the second duct assembly may be coupled to the first duct assembly.

In addition, in the refrigerator of the present disclosure, a receiving protrusion of the second duct assembly may be configured to be bent in the receiving groove of the first duct assembly. Accordingly, the coupling of the second duct assembly to the first duct assembly may be efficiently performed.

Furthermore, in the refrigerator of the present disclosure, the second duct assembly may be installed to block the front of the blower fan assembly.

Additionally, in the refrigerator of the present disclosure, the second duct assembly may be installed to simultaneously block the fronts of the blower fan assembly and the evaporator.

In addition, in the refrigerator of the present disclosure, the second duct assembly may include a first part. Accordingly, the flow of cold air to be introduced to the blower fan assembly may be efficiently performed.

Furthermore, in the refrigerator of the present disclosure, the second duct assembly may include a second part. Accordingly, the exposure of the evaporator to the outside may be prevented.

Additionally, in the refrigerator of the present disclosure, a boundary portion between the first part and the second part may be located to be adjacent to a portion through which cold air is introduced into the blower fan assembly. Accordingly, the cold air passing through the evaporator may easily flow to the cold air introduction hole of the blower fan assembly.

In addition, in the refrigerator of the present disclosure, a portion of the second part blocking the evaporator may be located to be more adjacent to the front surface of the evaporator than a portion of the second part blocking the blower fan assembly. Accordingly, cold air may pass through the upper side of the evaporator, so the heat exchange efficiency of the evaporator with the cold air may be improved.

Furthermore, in the refrigerator of the present disclosure, an introduction duct may be formed at the lower end of the second duct assembly. Accordingly, cold air flowing on the bottom of the storage compartment may flow to the evaporator through the introduction duct.

Additionally, in the refrigerator of the present disclosure, a filtering member may be provided in the introduction duct. Accordingly, foreign matter contained in cold air flowing to the evaporator may be filtered.

In addition, in the refrigerator of the present disclosure, the filtering member may be detachably installed in the introduction duct. Accordingly, the replacement of the filtering member may be performed.

Furthermore, in the refrigerator of the present disclosure, the blower fan assembly may be coupled to the lower end of the first duct assembly. Accordingly, the blower fan assembly may be constantly placed in a predetermined position.

Additionally, in the refrigerator of the present disclosure, the blower fan assembly may include a front housing in which the cold air introduction hole is formed. Accordingly, cold air may be introduced to the blower fan assembly from the front side of a blower fan.

In addition, in the refrigerator of the present disclosure, the blower fan assembly may include a rear housing blocking the rear of the blower fan. Accordingly, the rear of the blower fan may be protected.

Furthermore, in the refrigerator of the present disclosure, the blower fan may be fixed to the front surface of the rear housing. Accordingly, the fixed state of the blower fan may be stably maintained.

Additionally, in the refrigerator of the present disclosure, the seating groove may be formed at the first duct assembly by being recessed therefrom. Accordingly, the blower fan assembly may be mounted to the precise position of the first duct assembly.

In addition, in the refrigerator of the present disclosure, the first duct assembly may include a multi duct. Accordingly, cold air may be supplied to each space inside the storage compartment.

Furthermore, in the refrigerator of the present disclosure, the first duct assembly may include a flow duct. Accordingly, cold air supplied through the multi duct may be efficiently guided to each portion of the multi duct.

Additionally, the refrigerator of the present disclosure, a cold air flow path formed in the flow duct may be configured to be blocked from an external environment by a blocking member.

In addition, in the refrigerator of the present disclosure, an upper discharge tube may be formed at the center of the upper end of the first duct assembly. Accordingly, cold air flowing upward through the cold air flow path may flow to a front guide duct through the upper discharge tube, and may be supplied to the front of the inside of the storage compartment.

Furthermore, in the refrigerator of the present disclosure, an upper discharge part may be provided at each of the opposite sides of the upper discharge tube of the upper end of the first duct assembly. Accordingly, cold air may be supplied to the upper surface of the inside of the storage compartment.

As described above, in the refrigerator of the present disclosure, the cold air introduction hole of the blower fan assembly may be located behind the front surface of the evaporator, thereby causing cold air passing through the evaporator to be efficiently introduced to the blower fan assembly without the rapid change of the flowing direction of the cold air.

In addition, in the refrigerator of the present disclosure, the cold air introduction hole of the blower fan assembly may be configured to be located between the front surface of the evaporator and the rear surface thereof, thereby reducing the flow resistance of cold air.

Furthermore, in the refrigerator of the present disclosure, the second part of the second duct assembly may be configured to block the entire portion of the front surface of the evaporator, and thus cold air passing through the evaporator may sufficiently pass through the evaporator, thereby improving the heat exchange efficiency of the evaporator.

Additionally, in the refrigerator of the present disclosure, the second duct assembly may be configured to be coupled to or decoupled from the first duct assembly by bending, thereby facilitating the removal of the second duct assembly from the first duct assembly and the maintenance of the blower fan assembly and the evaporator.

In addition, in the refrigerator of the present disclosure, a machine room may be configured to be located at the lower portion of a rear side inside a casing, thereby decreasing the entire height of the refrigerator and securing more storage space than a refrigerator having the same height.

Furthermore, in the refrigerator of the present disclosure, the bent portion of the second duct assembly may be located to be adjacent to a portion through which cold air is introduced into the blower fan assembly, thereby facilitating the flow of the cold air passing through the evaporator to the cold air introduction hole of the blower fan assembly.

Additionally, in the refrigerator of the present disclosure, the filtering member may be provided at the introduction duct, thereby filtering foreign matter contained in cold air flowing to the evaporator.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Hereinafter, an exemplary embodiment of the present disclosure will be described in detail with reference to FIGS. 1 to 24.

Figure 1:
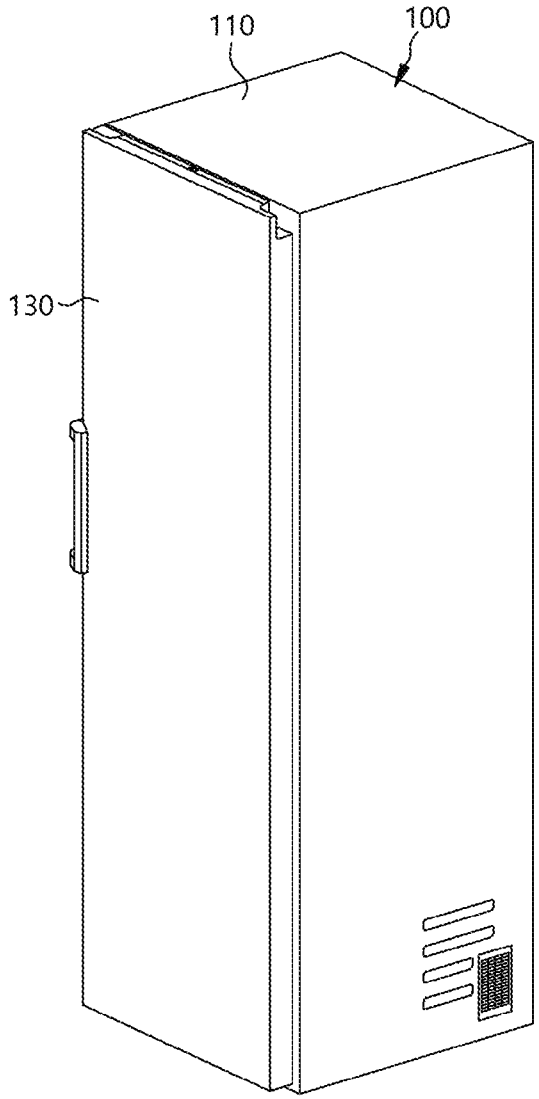
FIG. 1 is a perspective view illustrated to describe the exterior structure of a refrigerator according to an embodiment of the present disclosure.
Figure 2:
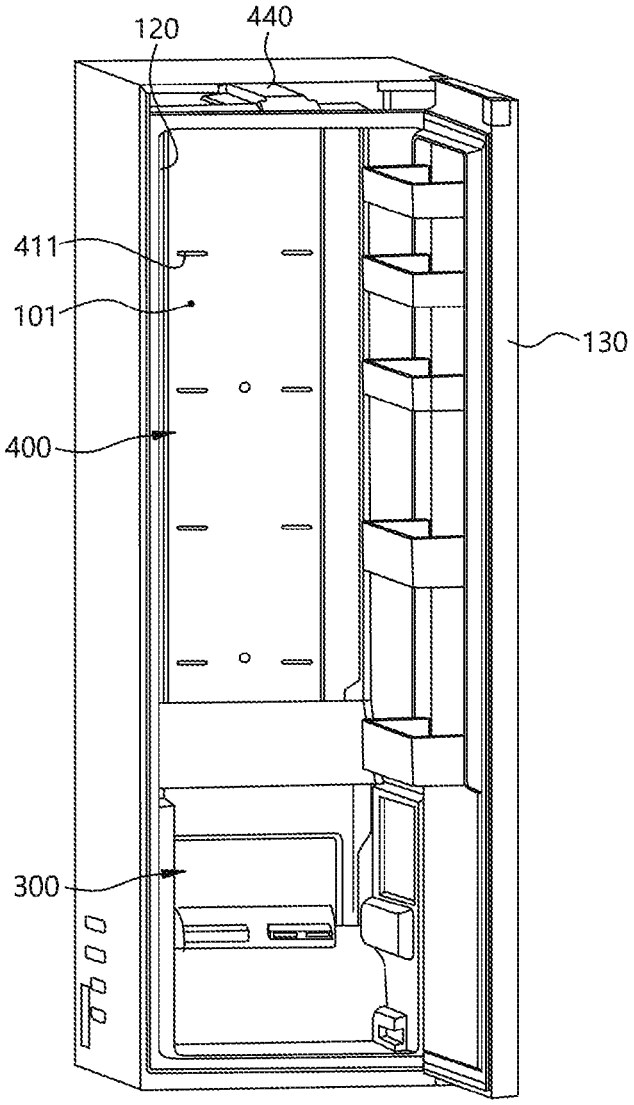
FIG. 2 is a perspective view illustrating the open state of a door to describe the inside of the refrigerator according to the embodiment of the present disclosure.

FIG. 1 is a perspective view illustrated to describe the exterior structure of a refrigerator according to an embodiment of the present disclosure, and FIG. 2 is a perspective view illustrating the open state of a door to describe the inside of the refrigerator according to the embodiment of the present disclosure.

Figure 3:
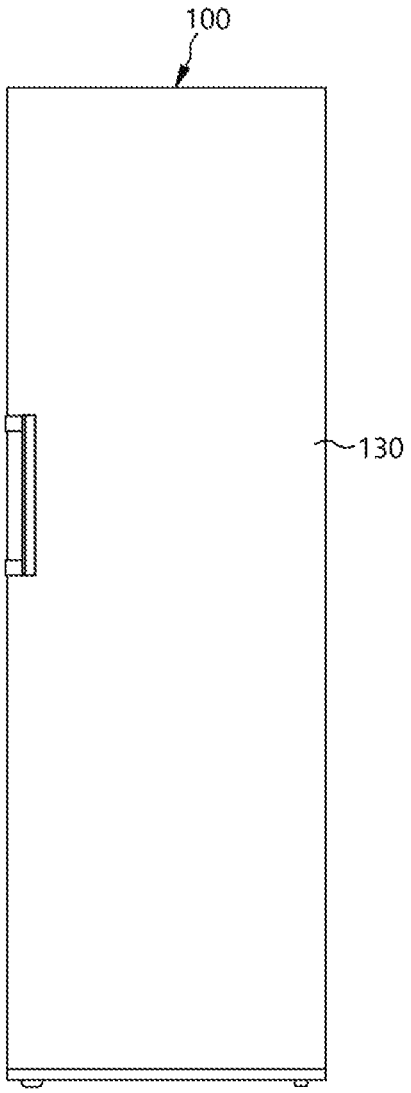
FIG. 3 is a front view illustrated to describe the exterior structure of the refrigerator according to the embodiment of the present disclosure.
Figure 4:
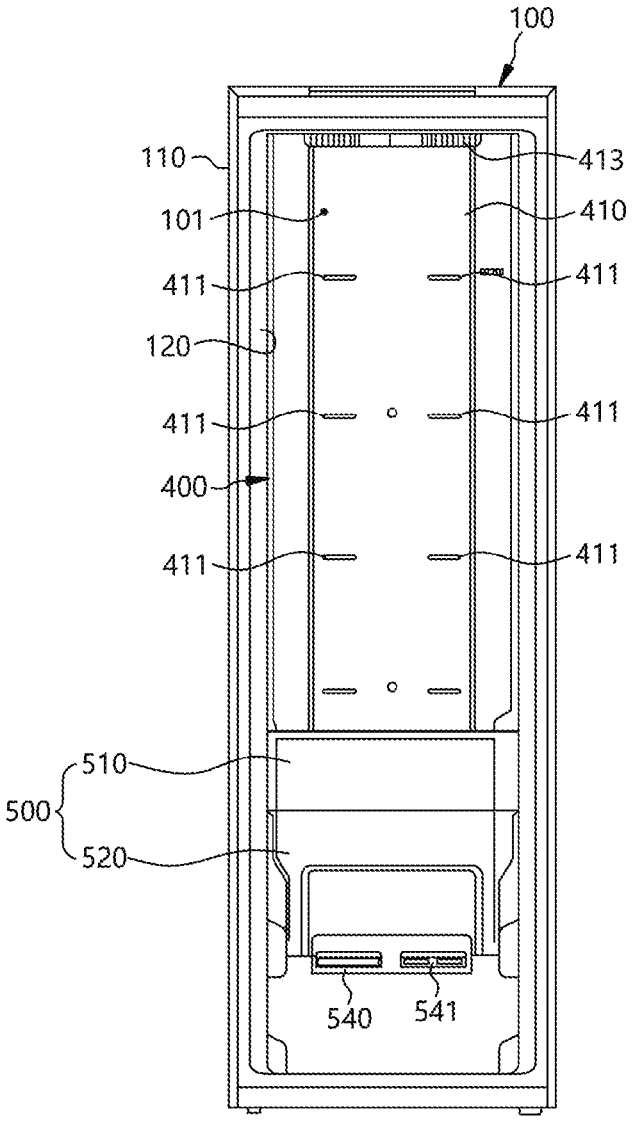
FIG. 4 is a front view illustrating the omitted state of the door to describe the inside of the refrigerator according to the embodiment of the present disclosure.

In addition, FIG. 3 is a front view illustrated to describe the exterior structure of the refrigerator according to the embodiment of the present disclosure, and FIG. 4 is a front view illustrating the omitted state of the door to describe the inside of the refrigerator according to the embodiment of the present disclosure.

Figure 5:
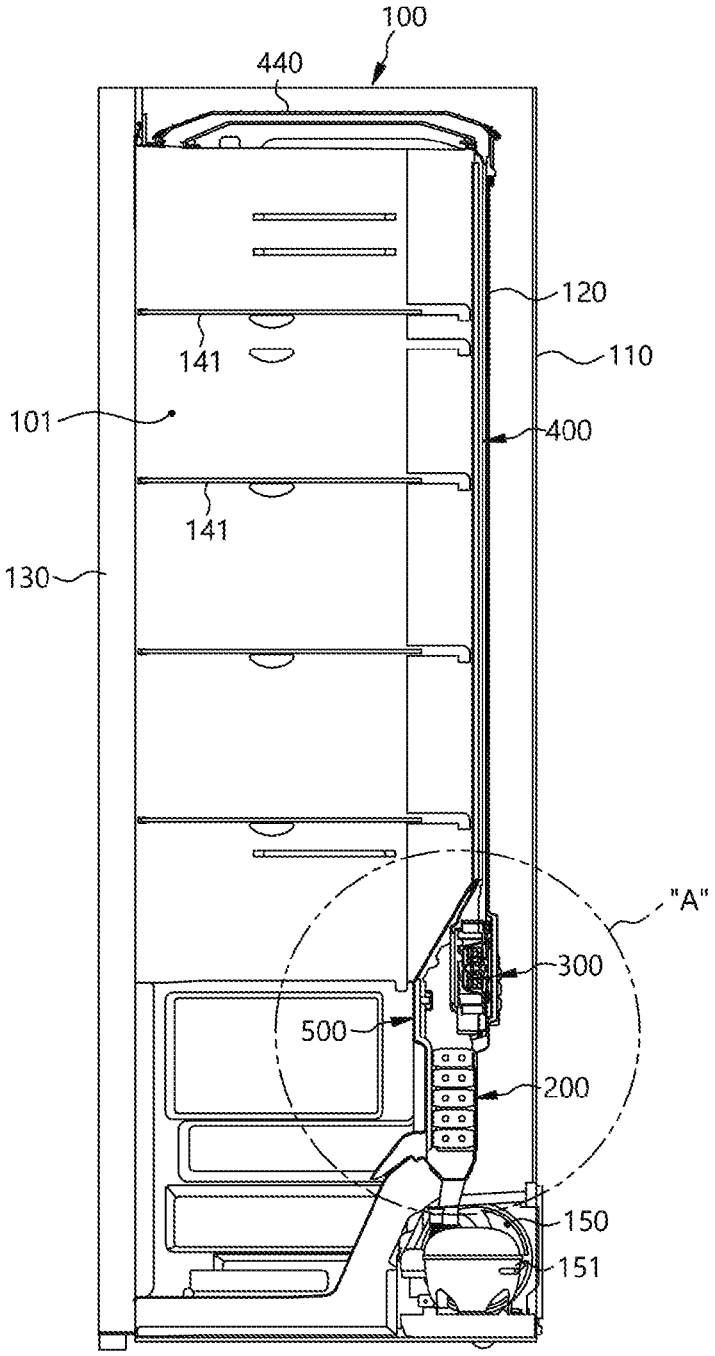
FIG. 5 is a sectional view illustrated to describe the structure of guiding the flow of cold air in the refrigerator according to the embodiment of the present disclosure.
Figure 6:
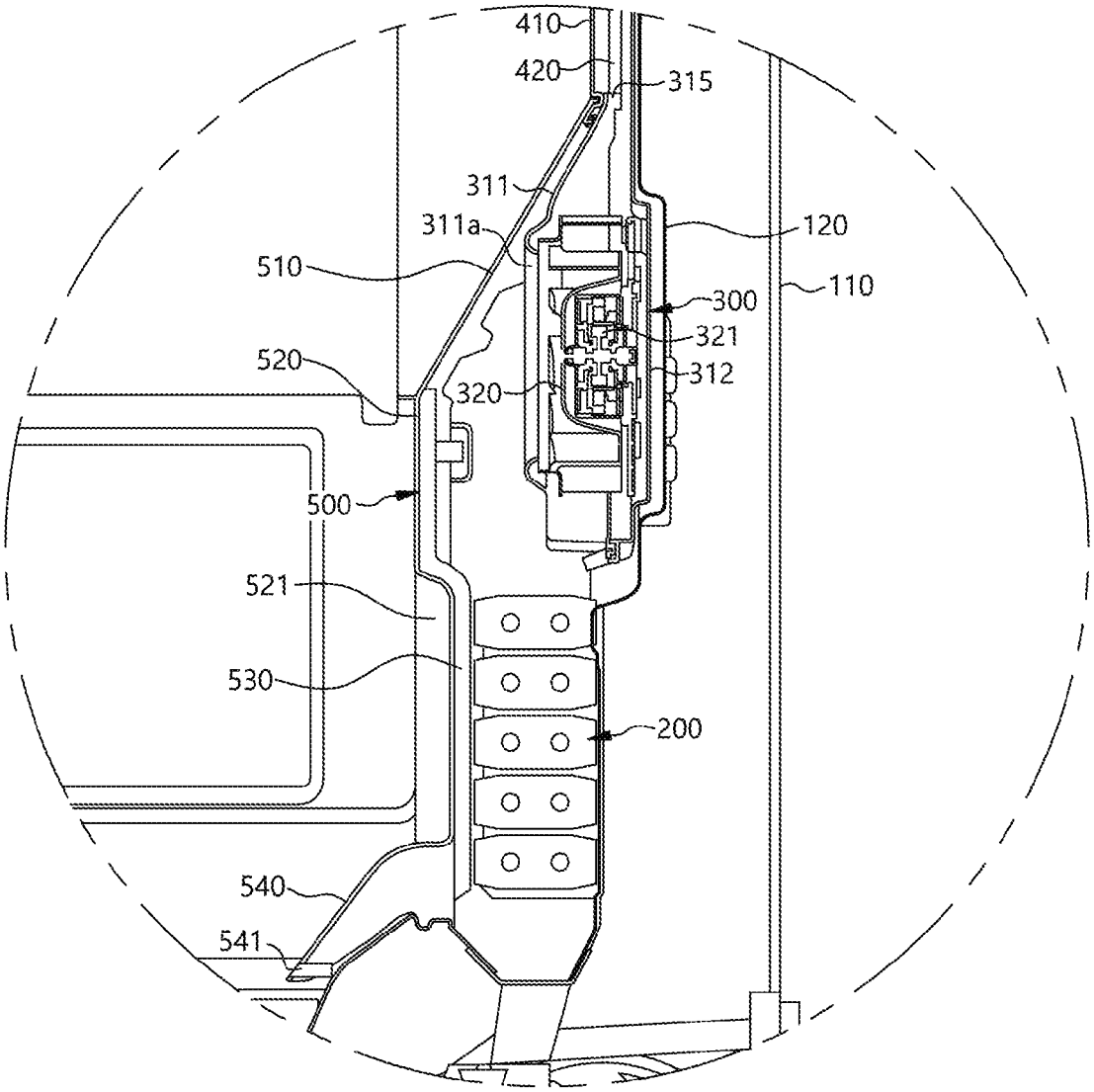
FIG. 6 is an enlarged view of an "A" part of FIG. 5.

Furthermore, FIG. 5 is a sectional view illustrated to describe the structure of guiding the flow of cold air in the refrigerator according to the embodiment of the present disclosure.

As illustrated in these drawings, the refrigerator of the present disclosure according to the embodiment may be provided as a single refrigerator or a convertible refrigerator in which at least two refrigerators may be arranged freely.

Furthermore, in the refrigerator according to the embodiment of the present disclosure, a structure for improving the installation positions of an evaporator 200 and a blower fan 320 may be provided, so the efficient supply of cold air may be performed.

In addition, in the refrigerator according to the embodiment of the present disclosure, the improved structures of duct assemblies 400 and 500 may be provided, so the efficient supply of cold air may be performed.

Each configuration of such a refrigerator according to the embodiment of the present disclosure will be described further in detail.

First, the refrigerator according to the embodiment of the present disclosure may include a cabinet 100.

The cabinet 100 may be configured to constitute the exterior of the refrigerator and to have the storage compartment.

The cabinet 100 may be configured as a casing open forward.

Such a cabinet 100 may include an outer casing 110 constituting an outer wall of the cabinet 100 and an inner casing 120 constituting an inner wall of the cabinet 100.

In this case, the storage compartment, which is a space in which goods are stored, may be located at the front of an evaporator 200 and at the front of each of first and second duct assemblies 400 and 500, the evaporator 200 and the first and second duct assemblies 400 and 500 being located in the inner space of the inner casing 120.

Although not shown, an insulator or foam may be filled between the outer casing 110 and the inner casing 120.

Of course, the outer casing 110 and the inner casing 120 of the cabinet 100 may be configured to be integrated with each other.

In addition, the door 130 may be installed at the open front surface of the cabinet 100 and may be configured to open and close the storage compartment. In this case, the door 130 may be a rotary door or a drawer-type door.

The storage compartment may be provided as one storage compartment. In this case, the one storage compartment may be provided with a plurality of shelves 141 or drawer-type storage boxes (not shown), and thus may be used by being divided into multiple storage spaces.

Next, the refrigerator according to the embodiment of the present disclosure may include a machine room 150.

A compressor 151 and a condenser (not shown) constituting the refrigeration cycle may be provided in the machine room 150.

Such a machine room 150 may be located at a rear bottom portion of space between the outer casing 110 and the inner casing 120 constituting the cabinet 100.

In this case, the lower edge of the rear side of the inner casing 120 constituting the cabinet 100 may be configured by inclining to avoid interference with space in which the machine room 150 is provided.

Next, the refrigerator according to the embodiment of the present disclosure may include the evaporator 200.

The evaporator 200 may be configured to cool cold air by exchanging heat between a refrigerant flowing inside a refrigerant tube and the cold air flowing outside the refrigerant tube.

The evaporator 200 may be located at the rear portion of the inside of the inner casing 120 and at the upper side of the machine room 150.

In this case, in each portion of the inner casing 120, a portion facing the evaporator 200 may be bent to be in close contact with the evaporator 200. Accordingly, cold air may be prevented from flowing to a portion between the evaporator 200 and the inner casing 120.

In addition, the evaporator 200 may vary in size depending on the intended use of the refrigerator.

For example, an evaporator used in a refrigerator for refrigeration may be configured to be smaller than an evaporator used in a refrigerator for freezing.

Meanwhile, a structure for cooling the cold air may not be limited to the evaporator 200.

That is, it may be possible to cool cold air by various other structures without cooling the cold air by using the heat exchange operation of the evaporator 200.

For example, it may also be possible to cool cold air by using a thermoelectric element.

Next, the refrigerator according to the embodiment of the present disclosure may include a blower fan assembly 300.

The blower fan assembly 300 may be a device configured to blow cold air passing through the evaporator 200.

The blower fan assembly 300 may be located at the upper side of the evaporator 200.

A cold air introduction hole 311*a* of the blower fan assembly 300 may be located behind the front surface of the evaporator 200.

That is, while cold air passing through the evaporator 200 flows upward, the cold air may pass through the cold air introduction hole 311*a* as efficiently as possible without the rapid change of the flowing direction of the cold air to be introduced into the blower fan assembly 300.

Of course, although not shown, the cold air introduction hole 311*a* of the blower fan assembly 300 may be located behind the rear surface of the evaporator 200. However, in this case, the flowing direction of cold air passing through the evaporator 200 may be bent at a large angle such that the cold air reaches the cold air introduction hole 311*a* of the blower fan assembly 300, so the loss of the cold air may occur. In addition, due to the position of the blower fan assembly 300 located behind the rear surface of the evaporator 200, the front-to-rear width of the inner casing 120 (or, the front-to-rear width of the outer casing) may be increased.

In consideration of this, the cold air introduction hole of the blower fan assembly 300 may be located behind the front surface of the evaporator 200 and at the front side of the rear surface of the evaporator 200.

Furthermore, the flow of cold air produced at the upper side of the evaporator 200 by the operation of the blower fan 320 may be directed from the front of the evaporator 200 toward the rear thereof. Accordingly, the cold air flowing upward from the lower portion of the evaporator 200 may be gradually directed to the front as the cold air flows toward the upper portion of the evaporator 200.

In consideration of this, the cold air introduction hole of the blower fan assembly 300 may be located between the front surface of the evaporator 200 and the rear surface thereof (for example, a center portion between the front surface of the evaporator and the rear surface thereof) such that the change of the flowing direction of cold air may be minimized and the flow resistance of the cold air may be reduced.

Figure 7:
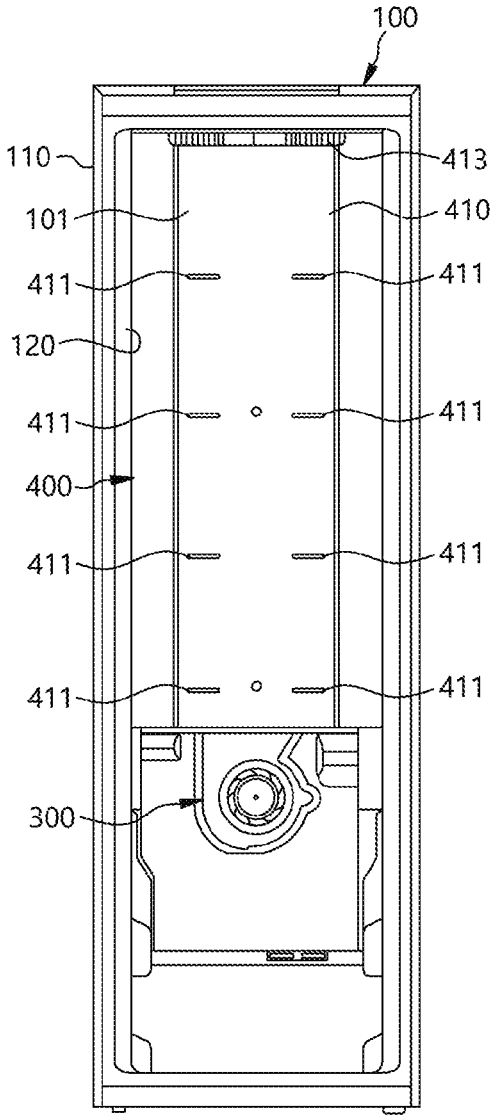
FIG. 7 is a front view illustrating a state of the inside of the refrigerator in a state in which the second duct assembly is omitted in the refrigerator according to the embodiment of the present disclosure.
Figure 8:
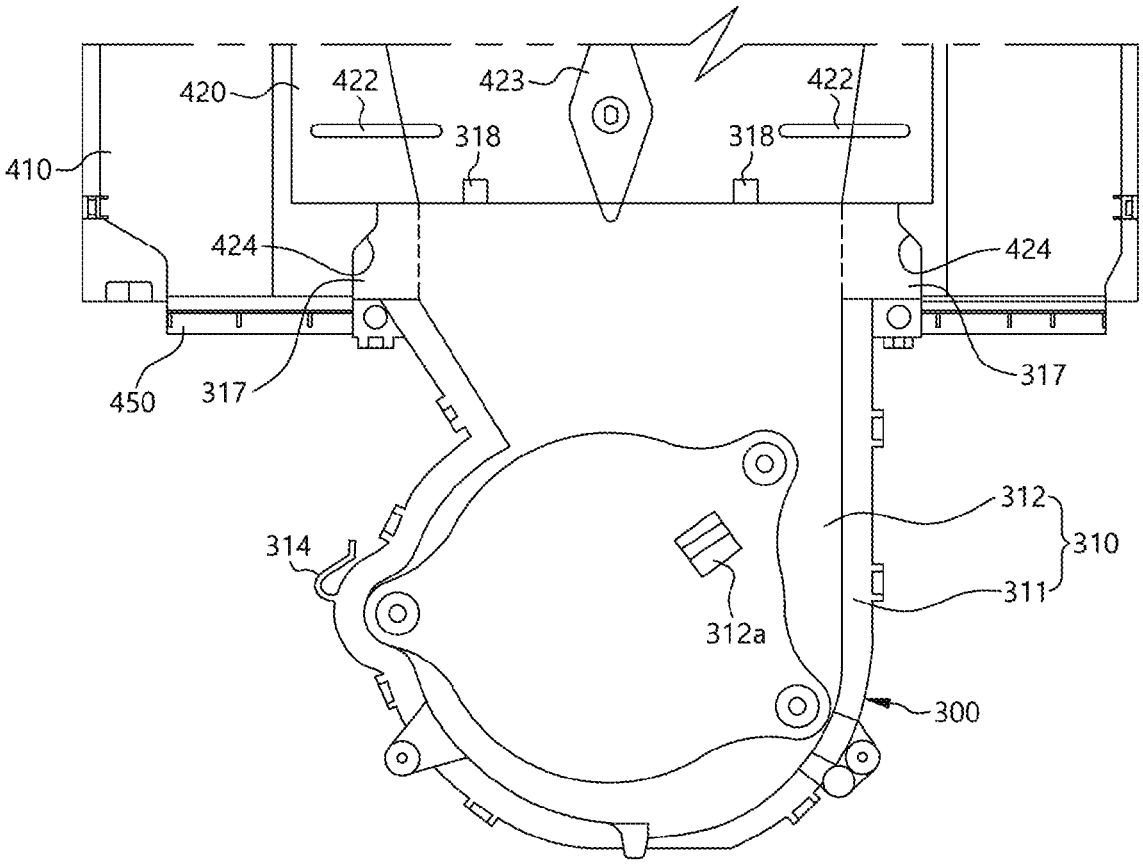
FIG. 8 is a rear perspective view illustrating the coupled state of the first duct assembly and a blower fan assembly to each other constituting the refrigerator according to the embodiment of the present disclosure.
Figure 9:
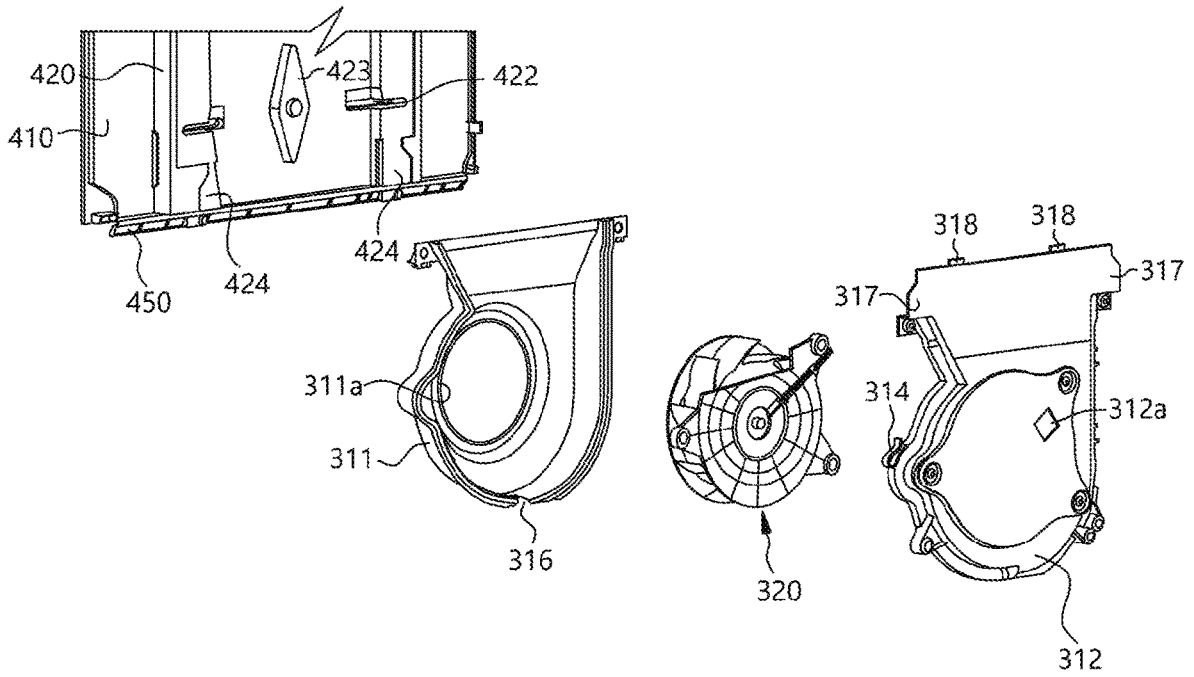
FIG. 9 is a front exploded perspective view illustrating the structure of the blower fan constituting the refrigerator according to the embodiment of the present disclosure.
Figure 10:
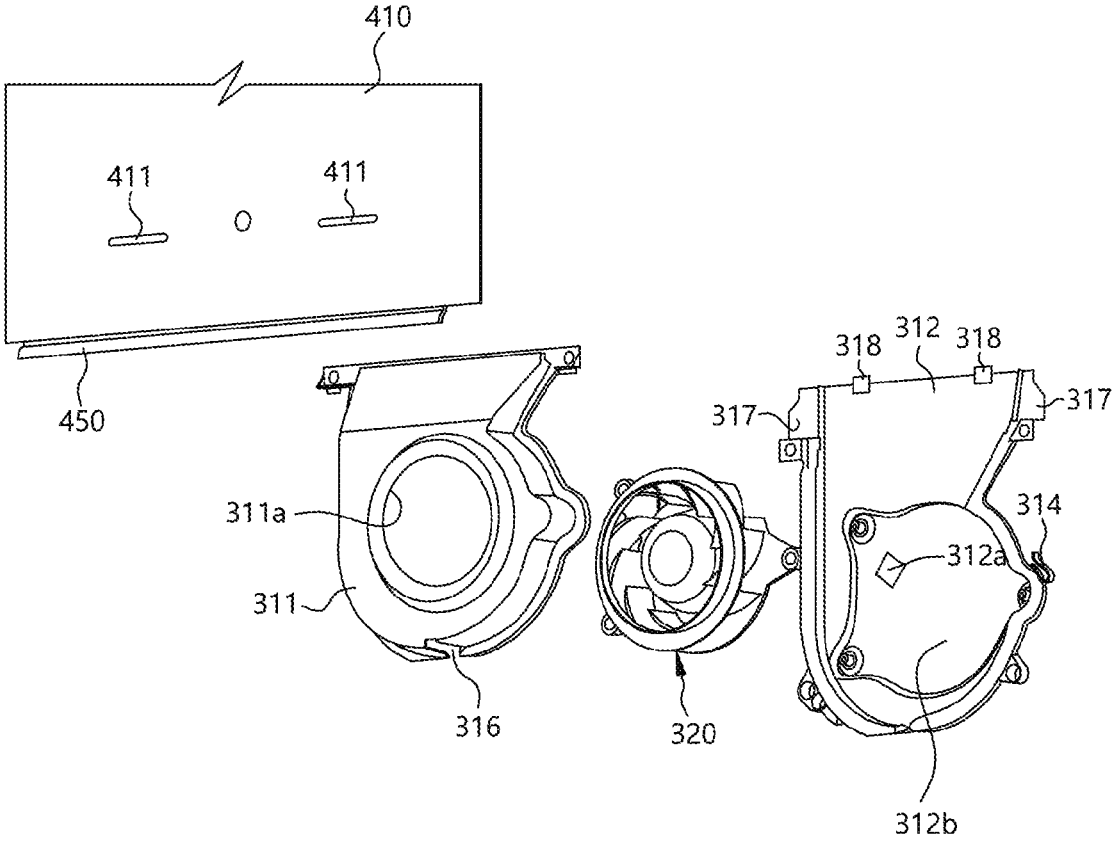
FIG. 10 is a rear exploded perspective view illustrating the structure of the blower fan constituting the refrigerator according to the embodiment of the present disclosure.

FIG. 7 is a front view illustrating the state of the inside of the refrigerator in a state in which the second duct assembly is omitted in the refrigerator according to the embodiment of the present disclosure; FIG. 8 is a rear perspective view illustrating the coupled state of the first duct assembly and the blower fan assembly to each other constituting the refrigerator according to the embodiment of the present disclosure; FIG. 9 is a front exploded perspective view illustrating the structure of the blower fan constituting the refrigerator according to the embodiment of the present disclosure; and FIG. 10 is a rear exploded perspective view illustrating the structure of the blower fan constituting the refrigerator according to the embodiment of the present disclosure.

As illustrated in FIGS. 7 to 10, the blower fan assembly 300 may include a fan housing 310 and the blower fan 320.

The fan housing 310 may protect the blower fan 320 and may function to guide the introduction of cold air to the blower fan 320 and the discharge of the cold air from the blower fan 320.

The fan housing 310 may include a front housing 311 constituting a front wall surface of the fan housing 310 and a rear housing 312 constituting a rear wall surface thereof.

In this case, the front housing 311 and the rear housing 312 may be hooked to each other.

Of course, although not shown, the front housing 311 and the rear housing 312 may be coupled to each other in various methods such as screwing or bonding.

One installation hook 314 or at least two installation hooks 314 may be formed at the outer surface or circumferential surface of the fan housing 310 such that a power line withdrawn outside of the blower fan 320 is held in the installation hook.

The cold air introduction hole 311*a* may be formed in the front housing 311. That is, the cold air introduction hole 311*a* of the fan housing 310 may be open forward. Accordingly, cold air flowing upward after passing through the evaporator 200 may be immediately introduced into the fan housing 310 through the cold air introduction hole 311*a*.

In addition, a cold air exit hole 315 may be formed in the upper surface of the fan housing 310.

The cold air exit hole 315 may be configured by spacing the front housing 311 apart from a portion of the upper end of the rear housing 312.

A condensate water discharge hole 316 may be formed in the lower surface of the fan housing 310.

A wire withdrawal hole 312*a* may be formed in the rear housing 312. In this case, the power line of the blower fan 320 withdrawn outside of the rear housing 312 through the wire withdrawal hole 312*a* may be arranged at the installation hook 314 by being held therein.

In addition, the fan housing 310 may be coupled to a flow duct 420 of the first duct assembly 400.

For example, with the upper end of the front housing 311 constituting the fan housing 310 located to overlap the lower end of the flow duct 420, the front housing 311 and the flow duct 420 may be screwed to each other.

The rear housing 312 may be fixed to the front housing 311. Alternatively, the rear housing 312 and the front housing 311 may together be screwed to the flow duct 420.

The coupling structure of the fan housing 310 and the flow duct 420 to each other will be described again in the description of the structure of the flow duct 420 to be described later.

The blower fan 320 constituting the fan housing 310 may be a normal centrifugal fan that introduces cold air in an axial direction thereof and discharges the cold air in a radial direction thereof.

A fan motor 321 operating the blower fan 320 may be configured to be integrated with the blower fan 320.

Particularly, the blower fan 320 may be fixed to the front surface of the rear housing 312.

A mounting groove 312*b* may be formed at the front surface of the rear housing 312 by being recessed therefrom, and may be configured such that a portion of the blower fan 320 is received and seated in the mounting groove 312*b* to be held therein.

Next, the refrigerator according to the embodiment of the present disclosure may include the first duct assembly 400.

Figure 11:
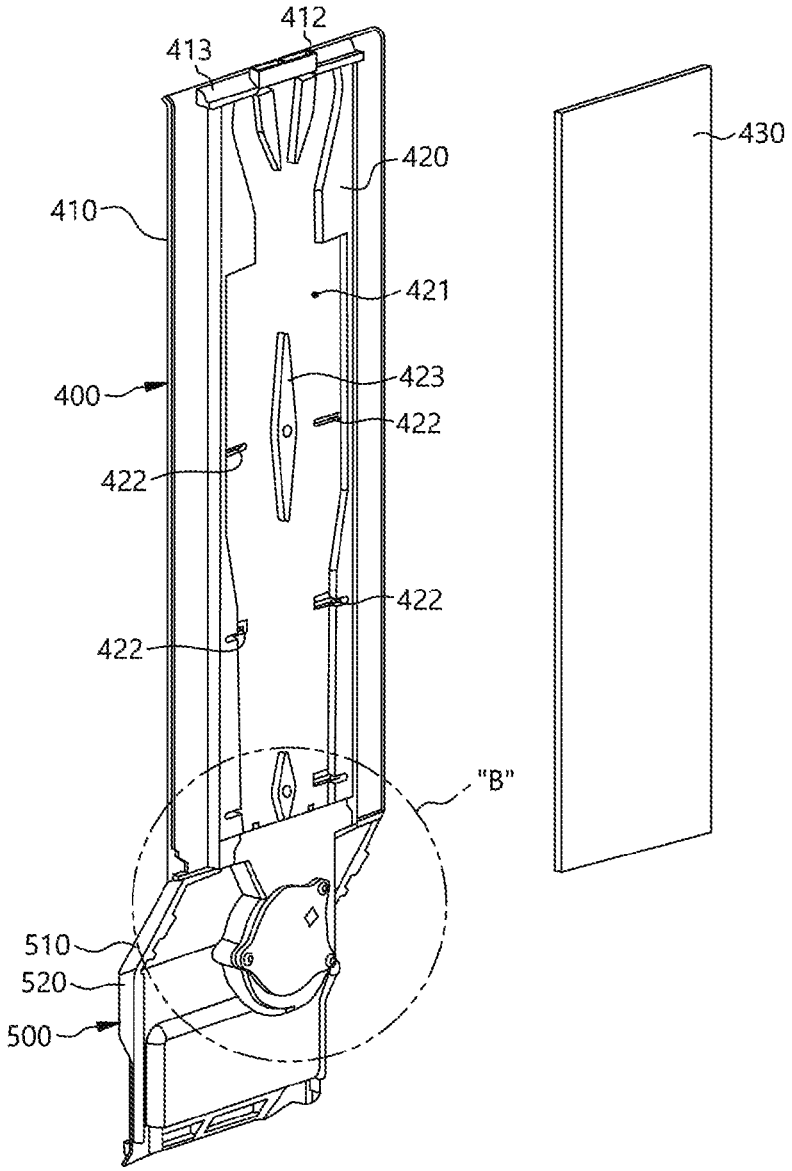
FIG. 11 is a rear perspective view illustrating a coupled state between the first duct assembly and the second duct assembly and the blower fan constituting the refrigerator according to the embodiment of the present disclosure.
Figure 12:
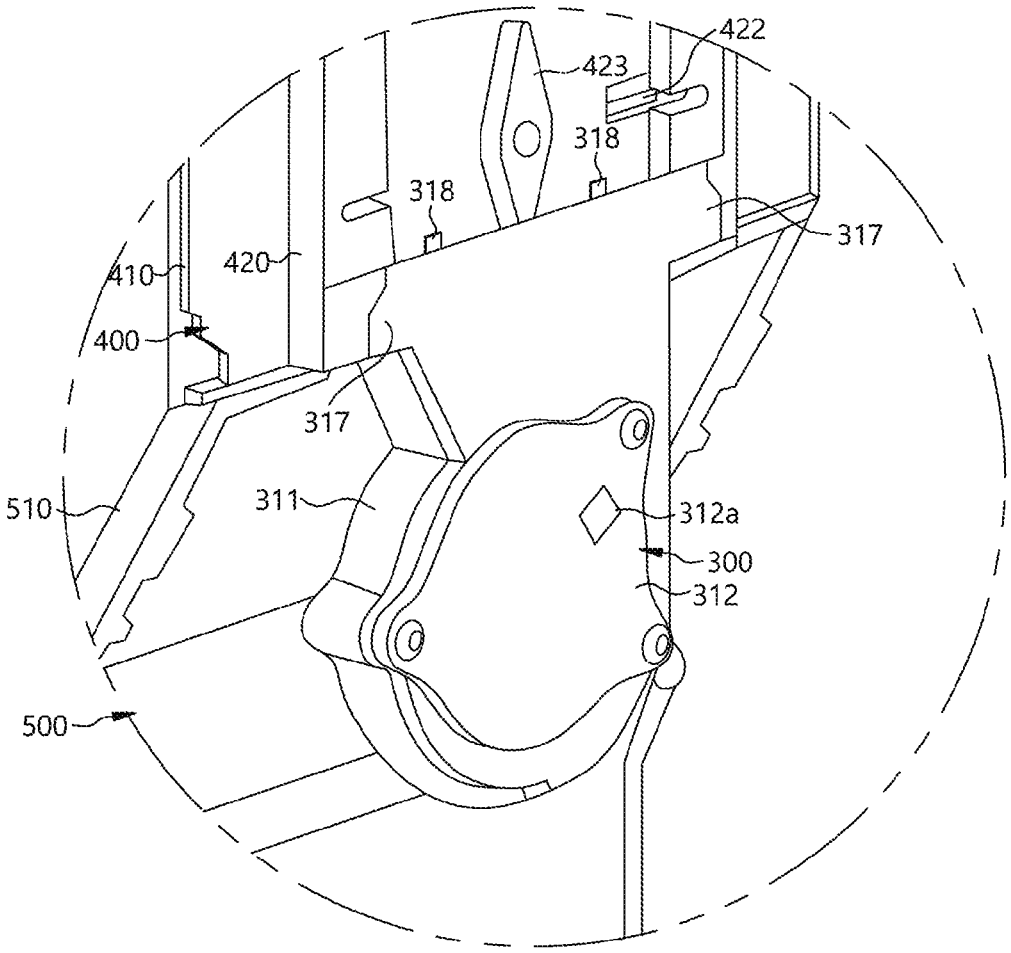
FIG. 12 is an enlarged view of a "B" part of FIG. 11.
Figure 13:
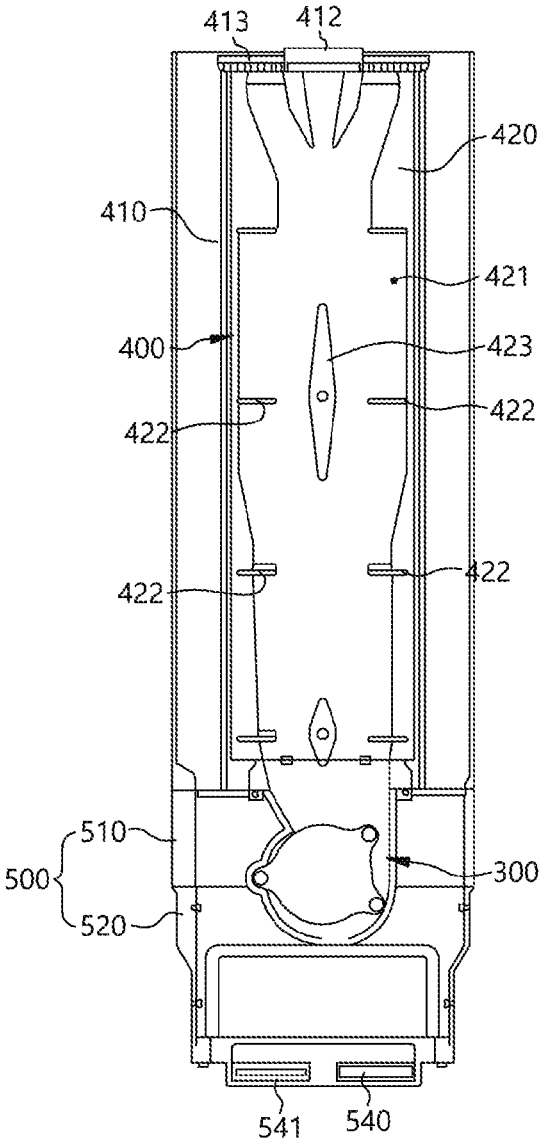
FIG. 13 is a rear view illustrating the coupled state between the first duct assembly and the second duct assembly and the blower fan constituting the refrigerator according to the embodiment of the present disclosure.
Figure 14:
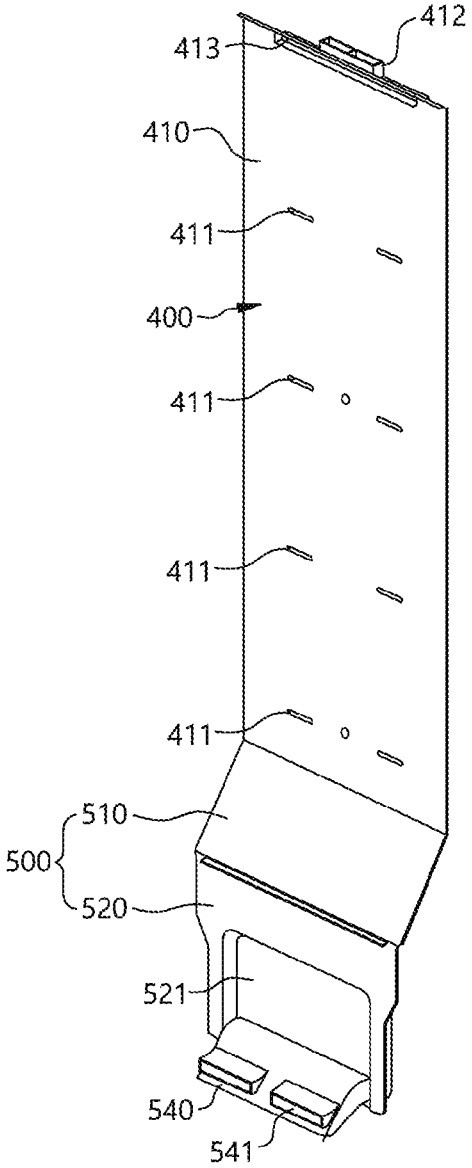
FIG. 14 is a front perspective view illustrating the coupled state between the first duct assembly and the second duct assembly and the blower fan constituting the refrigerator according to the embodiment of the present disclosure.
Figure 15:
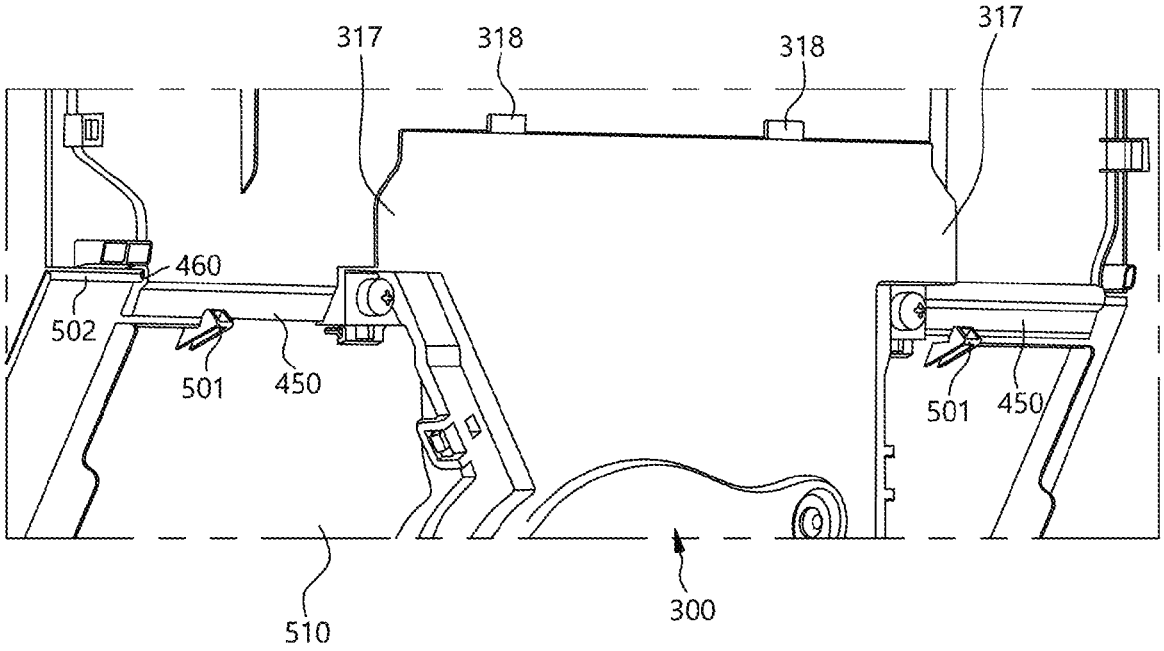
FIG. 15 is a rear perspective view illustrating the coupled state of the first duct assembly and the blower fan assembly constituting the refrigerator according to the embodiment of the present disclosure.
Figure 16:
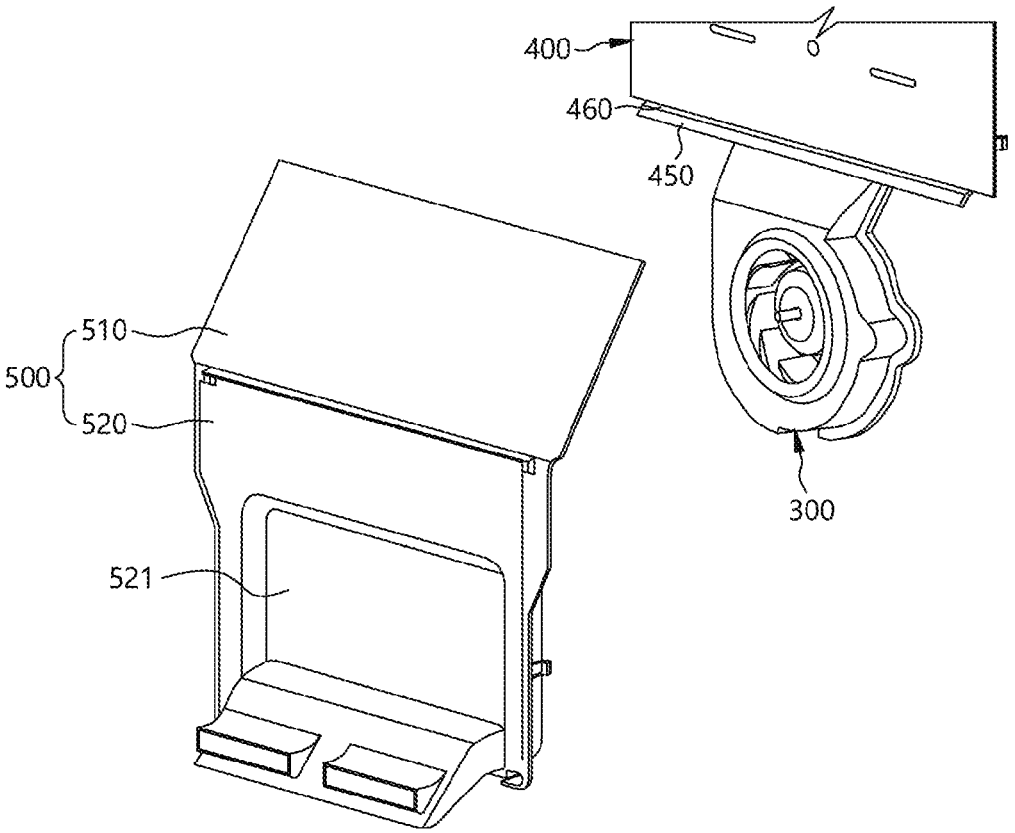
FIG. 16 is a perspective view illustrating the coupling relation of the first duct assembly and the second duct assembly constituting the refrigerator according to the embodiment of the present disclosure.

FIG. 11 is a rear perspective view illustrating a coupled state between the first duct assembly and the second duct assembly and the blower fan constituting the refrigerator according to the embodiment of the present disclosure; FIG. 12 is an enlarged view of a "B" part of FIG. 11; FIG. 13 is a rear view illustrating the coupled state between the first duct assembly and the second duct assembly and the blower fan constituting the refrigerator according to the embodiment of the present disclosure; and FIG. 14 is a front perspective view illustrating the coupled state between the first duct assembly and the second duct assembly and the blower fan constituting the refrigerator according to the embodiment of the present disclosure.

As illustrated in FIGS. 11 to 14, the first duct assembly 400 may constitute a portion of the rear wall surface of the inside of the storage compartment.

In addition, the first duct assembly 400 may function to receive cold air supplied from the blower fan assembly 300 and to supply the cold air to the inside of the storage compartment.

The first duct assembly 400 may be located in the inner casing 120. In this case, the first duct assembly 400 and the inner casing 120 may be arranged to be spaced apart from each other or to be in contact with each other.

The first duct assembly 400 may include a multi duct 410 and the flow duct 420.

The multi duct 410 may be provided as a wall surface exposed to the inside of the storage compartment, and a plurality of cold air discharge holes 411 may be formed in the wall surface. The cold air discharge holes 411 may be configured to discharge cold air to each storage space inside the storage compartment 101 (space between a shelf and a shelf, or space between a shelf and the storage box).

The flow duct 420 may be a part in which a cold air flow path 421 for guiding the flow of cold air is formed.

The cold air flow path 421 may be formed at the rear surface of the flow duct 420 by being recessed therefrom, and may be formed from the lower end surface of the flow duct 420 to the upper end surface thereof.

Communication holes 422 configured to discharge cold air flowing along the cold air flow path 421 to the storage compartment may be formed in the flow duct 420.

The communication holes 422 may be configured to correspond to the cold air discharge holes 411 of the multi duct 410.

That is, cold air flowing along the cold air flow path 421 may pass through the communication holes 422 and the cold air discharge holes 411, and may be discharged to the storage compartment.

The blocking member 430 may be provided at the rear surface of the flow duct 420, and thus may be configured to cover the cold air flow path 421.

In this case, the blocking member 430 may be configured as an insulator.

An upper discharge tube 412 discharging cold air upward may be formed at the center of the upper end of the multi duct 410.

The upper discharge tube 412 may be configured such that some portion of cold air flowing along the cold air flow path 421 of the flow duct 420 is discharged through the upper discharge tube 412.

In addition, a front guide duct 440 may be connected to the upper discharge tube 412.

The front guide duct 440 may be a duct which guides the direct supply of cold air supplied from the upper discharge tube 412 to the front space of the inside of the storage compartment.

Such a front guide duct 440 may be provided along the outer wall surface of the upper surface (a ceiling) constituting the inner casing 120. The rear end of the front guide duct 440 may be connected to the upper discharge tube 412, and the front end of the front guide duct 440 may be configured such that cold air passes through the front upper surface of the storage compartment and is discharged toward the bottom of the inside of the storage compartment. This is illustrated in FIGS. 19 to 22.

An upper discharge part 413 discharging cold air toward a front thereof may be formed at each of the opposite sides of the upper discharge tube 412 of the upper end of the multi duct 410.

The two upper discharge parts 413 may be configured to be open such that the remaining portion of the cold air flowing along the cold air flow path 421 of the flow duct 420 is discharged through the two upper discharge parts 412.

The upper surface of the upper discharge part 413 may be configured to be round.

That is, the cold air flowing upward toward a part at which the upper discharge part 413 is located may be discharged toward the front of the upper discharge part 412 by the guidance of the round upper surface of the upper discharge part 413 in the process of passing through the upper discharge part 413.

A plurality of dam parts 423 may be formed in the cold air flow path 421.

Each of the dam parts 423 may guide the discharge of cold air flowing upward along the cold air flow path 421 to each of the communication holes 422 and may prevent the sagging of a portion of the upper end of the blower fan assembly 300 connected to the cold air flow path 421.

According to the embodiment, as illustrated in the drawings, the dam part 423 may be configured as a rhombic structure.

Of course, although not shown, the dam part may be configured to have various shapes such as circular, semicircular, oval, triangular, polygonal, and round shapes according to the condition of the cold air flow path.

Meanwhile, the blower fan assembly 300 may be coupled to the lower end of the first duct assembly 400.

Specifically, the cold air flow path 421 of the flow duct 420 may be configured to be open downward, and with the cold air exit hole 315 of the fan housing 310 constituting the blower fan assembly 300 located to correspond to the open lower portion of the cold air flow path 421, the fan housing 310 may be screwed to the lower end of the multi duct 410.

Furthermore, the seating groove 424 may be formed at the lower end portion of the rear surface of the first duct assembly 400 by being recessed therefrom. The seating groove 424 may be formed at the lower end of the flow duct 420.

In addition, a seating end 317 may be formed at the upper end of the fan housing 310 constituting the blower fan assembly 300 such that seating end 317 is seated in the seating groove 424. The seating end 317 may extend upward from the upper end of the rear housing 312.

In this case, a resting protrusion 318 may be formed on the seating end 317 such that the lower end of the blocking member 430 rests on the resting protrusion 318. Due to the resting protrusion 318, the blocking member 430 may be installed at a precise position and the lower end of the blocking member 430 may be prevented from sagging.

Meanwhile, at least one the dam part 423 famed in the cold air flow path 421 may be configured to support the center portion of the seating end 317. Accordingly, the center portion of the seating end 317 may be prevented from sagging.

Next, the refrigerator according to the embodiment of the present disclosure may include the second duct assembly 500.

The second duct assembly 500 may be configured to constitute the remaining wall surface except for the first duct assembly 400 in the rear wall surface of the inside of the storage compartment.

More specifically, the second duct assembly 500 may function to block portions at which the blower fan assembly 300 and the evaporator 200 are located.

Of course, although not shown, the second duct assembly 500 may be configured to block only the front of the blower fan assembly 300, and the evaporator 200 may be configured to be blocked by a separate duct assembly.

The second duct assembly 500 may be coupled to the lower end portion of the first duct assembly 400.

Particularly, a support part 450 may be formed at the lower end of the first duct assembly 400 by protruding downward therefrom, and the upper end of the second duct assembly 500 may be installed to be supported by the front surface of the support part 450.

In this case, the support part 450 may be famed to incline.

In addition, at least one restraining protrusion 501 held and restrained by the support part 450 may be formed at the rear surface of the second duct assembly 500.

That is, due to the coupled structure of the support part 450 and the restraining protrusion 501, the second duct assembly 500 may be prevented from being spaced apart from the first duct assembly 400. This is illustrated in FIGS. 15 to 18.

In addition, a receiving groove 460 may be formed at the front surface of the lower end of the first duct assembly 400 by being recessed therefrom, and a receiving protrusion 502 received in the receiving groove 460 may be formed at the upper end of the second duct assembly 500 by protruding therefrom.

In this case, the receiving protrusion 502 may be configured to be bent in the receiving groove 460.

That is, after the receiving protrusion 502 is first inserted to the receiving groove 460 and the second duct assembly 500 is bent, the restraining protrusion 501 of the second duct assembly 500 may be held and restrained by the support part 450 of the first duct assembly 400.

The second duct assembly 500 may include a first part 510 and a second part 520.

The first part 510 may be located to block the front of the blower fan assembly 300, and may be configured to gradually incline forward from the lower end of the first duct assembly 400 downward.

That is, cold air passing through the evaporator 200 may efficiently flow to the cold air introduction hole 311*a* of the fan housing 310 constituting the blower fan assembly 300 by the guidance of the first part 510 described above.

In addition, the second part 520 may be configured to be bent from the first part 510.

The boundary portion between the first part 510 and the second part 520 may be configured to be located at a portion at which cold air is introduced into the blower fan assembly 300.

That is, due to the structure of the second duct assembly 500 described above, the cold air passing through the evaporator 200 may efficiently flow to the cold air introduction side (the cold air introduction hole of the fan housing) of the blower fan assembly 300.

In addition, an adjacent protrusion part 521 protruding toward the evaporator 200 may be formed on the surface of the second part 520 facing the evaporator 200.

Due to such an adjacent protrusion part 521, the portion of the second part 520 facing the evaporator 200 may be located to be more adjacent to the evaporator 200 than a portion of the second part 520 blocking the blower fan assembly 300. Accordingly, cold air may completely pass through the evaporator 200, so the heat exchange efficiency of the evaporator 200 may be improved.

In this case, the upper end of the adjacent protrusion part 521 may be configured to be round forward. Accordingly, cold air may be introduced to the cold air introduction hole 311*a* not only from a lower side of the cold air introduction hole 311*a*, but also may be evenly introduced to the cold air introduction hole 311*a* from other directions thereof.

An insulating member 530 may be provided between the adjacent protrusion part 521 and the evaporator 200. The insulating member 530 may function to prevent the temperature of the evaporator 200 from being directly conducted to the second duct assembly 500.

In this case, the insulating member 530 may be configured to a boundary portion between the second part 520 and the first part 510. Accordingly, cold air passing through the evaporator 200 may be prevented from being influenced by the temperature of the second duct assembly 500, or the evaporator 200 may be prevented from being influenced by the temperature of the second duct assembly 500.

In addition, an introduction duct 540 may be formed at the lower end of the second duct assembly 500.

The introduction duct 540 may be a part which guides the flow of cold air recovered after flowing in the storage compartment toward the cold air introduction side of the evaporator 200.

Such an introduction duct 540 may be configured by protruding toward the inside of the storage compartment, or may be configured to gradually incline downward or be curved forward.

Particularly, the introduction duct 540 may be configured to have an inclination or curve similar to or the same inclination or curve as the inclination or curve of the rear lower edge of the bottom of the inner casing 120, which is configured for the machine room 150.

Furthermore, a filtering member 541 may be provided in the introduction duct 540.

The filtering member 541 may be located in the flow path between the introduction duct 540 and the bottom of the inner casing 120 by passing through the introduction duct 540, and thus may function to filter odor components or foreign matter contained in cold air flowing toward the evaporator 200 after the cold air passes through the flow path.

In this case, the filtering member 541 may be installed in the introduction duct 540 to be detached forward. Accordingly, the filtering member may be replaced or cleaned periodically by a user.

Next, in the refrigerator according to the embodiment of the present disclosure, the coupling process of the blower fan assembly 300 and each of the duct assemblies 400 and 500 to each other will be described more in detail.

First, the first duct assembly 400 and the second duct assembly 500, and the blower fan assembly 300 may be prepared.

The first duct assembly 400 may be provided by coupling the multi duct 410 and the flow duct 420 to each other.

In this case, the cold air flow path 421 may be arranged to be located at the rear surface of the flow duct 420, and with the communication holes 422 of the flow duct 420 arranged to correspond to the cold air discharge holes 411 of the multi duct 410, the flow duct 420 may be coupled to the multi duct 410.

In addition, the blocking member 430 may be provided at the rear surface of the flow duct 420, and may be configured to block the cold air flow path 421. Of course, after the blower fan assembly 300 is coupled to the first duct assembly 400, the blocking member 430 may be coupled to the rear surface of the flow duct 420.

In the blower fan assembly 300, the front housing 311 and the rear housing 312 may be provided by being coupled to each other, with the blower fan 320 placed therebetween.

In this case, the front housing 311 and the rear housing 312 may be hooked to each other to be integrated with each other.

In addition, the power line (not shown) connected to the blower fan 320 may be withdrawn through the wire withdrawal hole 312*a* formed in the rear housing 312 and then may be connected to the power supply of the refrigerator.

In addition, the blower fan assembly 300 may be coupled to the prepared first duct assembly 400.

In the blower fan assembly 300, the cold air exit hole 315 of the fan housing 310 may match the cold air flow path 421 formed in the flow duct 420 of the first duct assembly 400, and the seating end 317 formed on the upper end of the fan housing 310 may be seated in the seating groove 424 formed at the lower end of the first duct assembly 400.

In this state, the fan housing 310 and the first duct assembly 400 may be screwed to each other to be integrated with each other.

In this case, the resting protrusion 318 formed on the seating end 317 may be configured such that the lower end of the blocking member 430 is placed on the resting protrusion 318. Accordingly, the lower end of the blocking member 430 may be prevented from sagging.

Of course, after the blower fan assembly 300 is coupled to the first duct assembly 400, the blocking member 430 may be coupled to the rear surface of the flow duct 420.

In addition, the first duct assembly 400 to which the blower fan assembly 300 is coupled may be installed in rear space inside the storage compartment.

The first duct assembly 400 and the inner casing 120 constituting the storage compartment may be hooked to each other. Of course, the first duct assembly 400 may be coupled to the inner casing 120 in various methods such as bonding or screwing.

In this case, the blower fan assembly 300 may be located at the upper side of the evaporator 200 located in lower space at a rear side inside the storage compartment.

In addition, when the installation of the first duct assembly 400 is completed, the second duct assembly 500 may be coupled to the first duct assembly 400.

The second duct assembly 500 may be coupled to the lower end of the first duct assembly 400.

Figure 23:
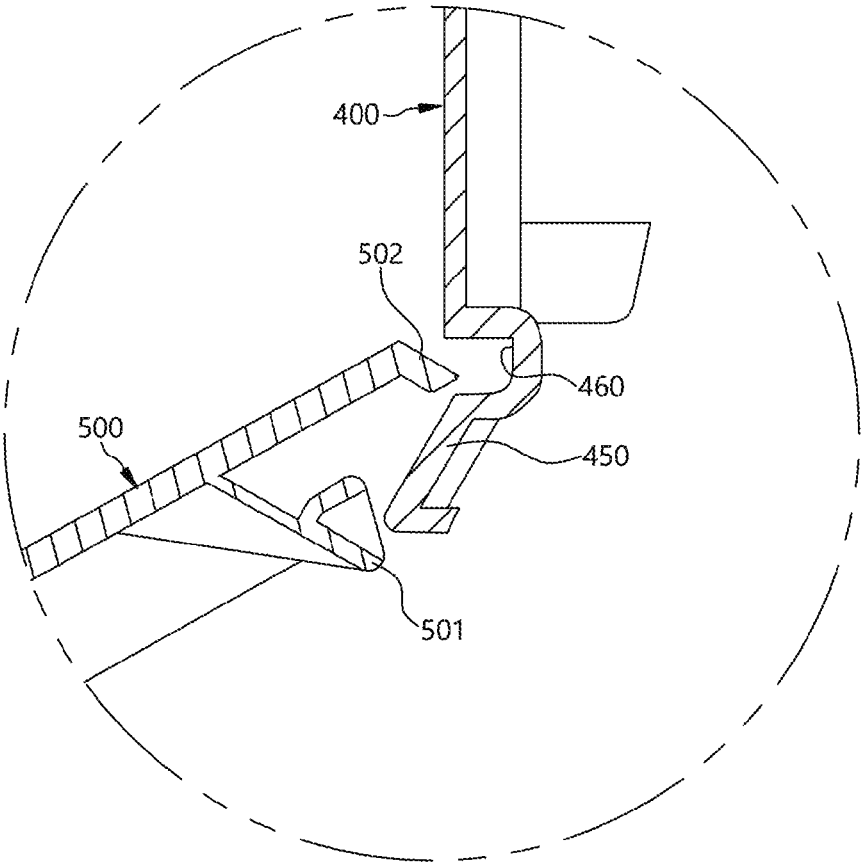
FIG. 23 is an enlarged sectional view illustrating a coupling process between the first duct assembly and the second duct assembly constituting the refrigerator according to the embodiment of the present disclosure.
Figure 24:
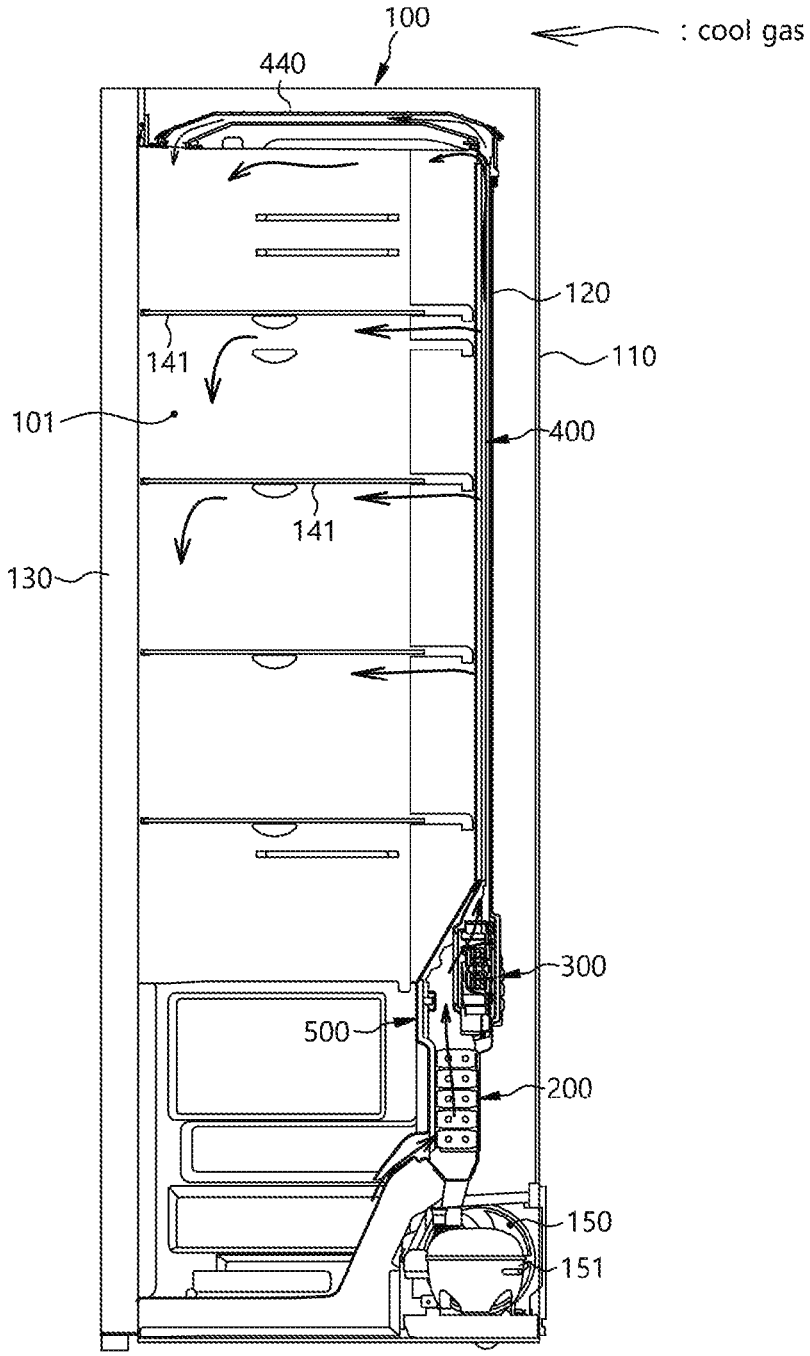
FIG. 24 is a sectional view illustrating the state of cold air flowing during the cooling operation of the refrigerator according to the embodiment of the present disclosure.

That is, after the receiving protrusion 502 formed on the upper end of the second duct assembly 500 may be correspondingly inserted to the receiving groove 460 formed in the front surface of the lower end of the first duct assembly 400, the second duct assembly 500 may be bent downward. This is illustrated in FIG. 23.

Figure 17:
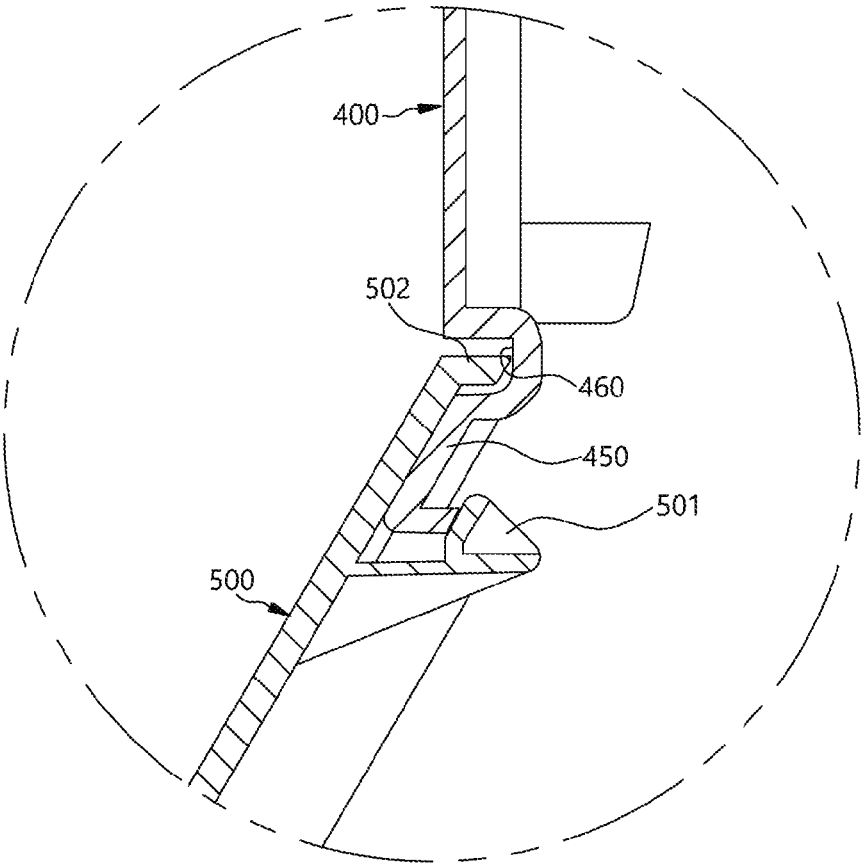
FIG. 17 is an enlarged sectional view illustrating the coupled relation of the first duct assembly and the second duct assembly constituting the refrigerator according to the embodiment of the present disclosure.
Figure 18:
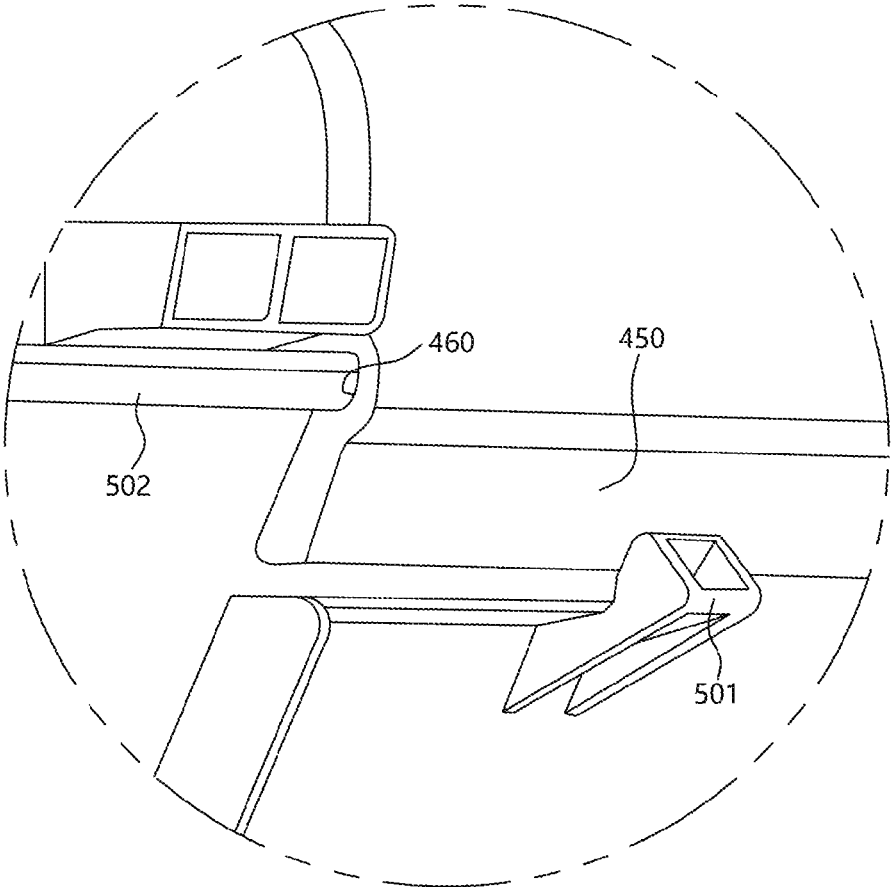
FIG. 18 is an enlarged perspective view illustrating the coupled relation of the first duct assembly and the second duct assembly constituting the refrigerator according to the embodiment of the present disclosure.
Figure 19:
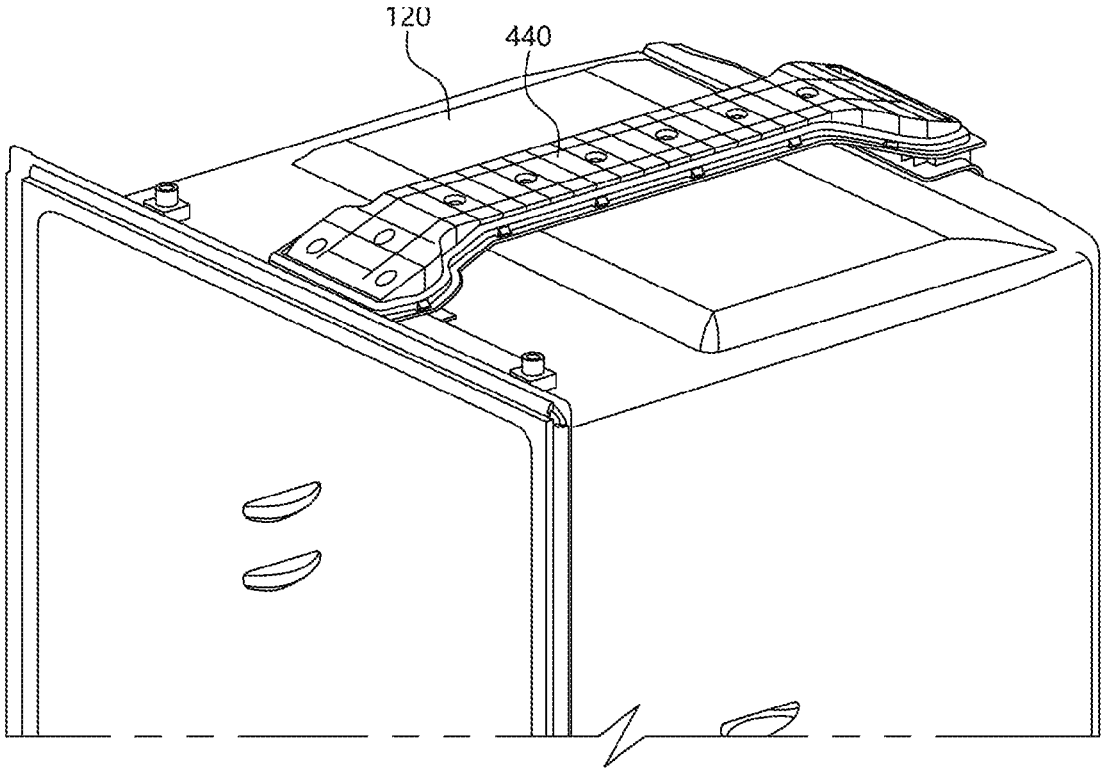
FIG. 19 is a perspective view illustrating the installed state of a front guide duct constituting the refrigerator according to the embodiment of the present disclosure.
Figure 20:
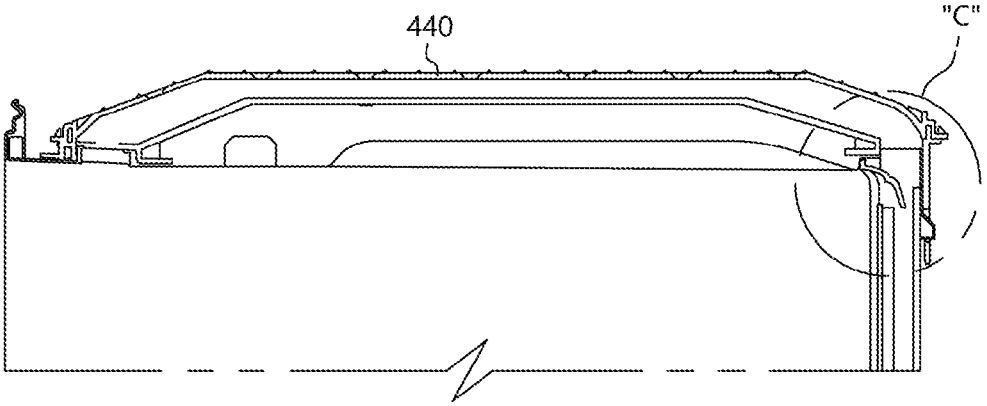
FIG. 20 is a view illustrating the installed state of the front guide duct constituting the refrigerator according to the embodiment of the present disclosure.
Figure 21:
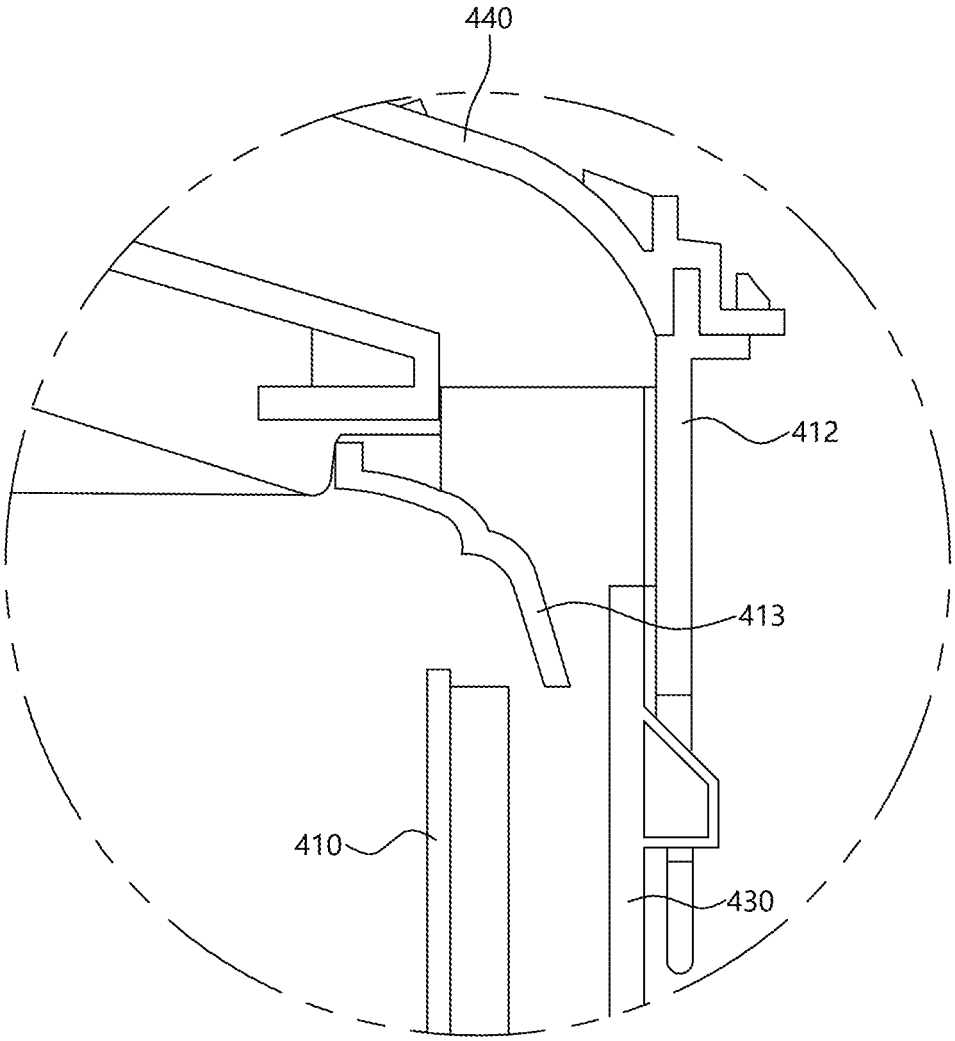
FIG. 21 is an enlarged view of a "C" part of FIG. 20.
Figure 22:
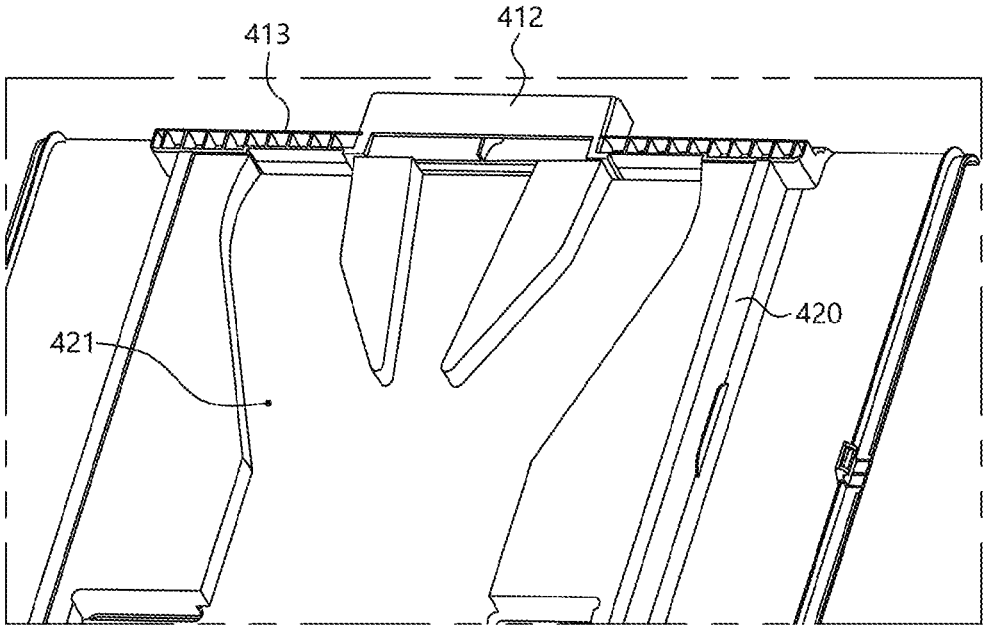
FIG. 22 is a perspective view illustrating the communication structure of an upper discharge part and an upper discharge tube of the first duct assembly with each other, the first duct assembly constituting the refrigerator according to the embodiment of the present disclosure.

Accordingly, as illustrated in FIG. 17, the upper end of the second duct assembly 500 may be located to be supported by the support part 450 formed at the lower end of the first duct assembly 400, and the restraining protrusion 501 formed on the rear surface of the second duct assembly 500 may be restrained by the rear surface of the support part 450, so the two duct assemblies 400 and 500 may be coupled to each other.

Accordingly, the blower fan assembly 300 and the evaporator 200 exposed to the lower portion of the first duct assembly 400 may be blocked from the inside of the storage compartment by the second duct assembly 500.

When a user performs the maintenance of the evaporator 200 or the blower fan assembly 300, the second duct assembly 500 may be decoupled from the first duct assembly 400.

In this case, when the second duct assembly 500 is forcibly bent upward by the user, the state of the restraining protrusion 501 restrained by the support part 450 may be released. Next, the receiving protrusion 502 of the second duct assembly 500 may be decoupled from the receiving groove 460 of the first duct assembly 400.

Next, the process of the cold air flow caused by the refrigeration operation of the refrigerator according to the embodiment of the present disclosure described above will be described with reference to FIG. 24.

The refrigeration operation may be performed by the operations of the blower fan 320 and the compressor 151.

That is, the rotation of the blower fan 320 by the supply of power to the blower fan 320 and the temperature control of the storage compartment by heat exchange operation of the evaporator 200 by the operation of the compressor 151 may be performed.

In addition, when the blower fan 320 rotates, air may be blown by the rotation.

That is, the cold air of the inside of the storage compartment may be introduced to the cold air introduction side of the evaporator 200 through the introduction duct 540 of the second duct assembly 500 by the blowing force of air caused by the rotation of the blower fan 320.

In this case, while the cold air passes through the introduction duct 540, the cold air may pass through the filtering member 541 installed through the introduction duct 540. In this case, various odor components and foreign matter contained in the cold air may be filtered.

In addition, while passing through the evaporator 200 located between the second part 520 of the second duct assembly 500 and the inner casing 120, cold air introduced to the cold air introduction side of the evaporator 200 may be cooled by heat exchange with refrigerant flowing inside the refrigerant tube of the evaporator 200.

In this case, cold air introduced to the cold air introduction side of the evaporator 200 while passing through the introduction duct 540 may flow to the rear surface of the inside of the evaporator 200 due to the speed of the cold air flowing in the direction of the cold air introduced to the cold air introduction side, and may flow upward.

In addition, the flow of the cold air flowing upward from the lower portion of the evaporator 200 may be gradually directed to the front of the inside of the evaporator 200 toward the upper side of the evaporator 200 by the operation of the blower fan 320 located at the upper side of the evaporator 200 and introducing air from the front of the blower fan 320 to the rear thereof.

Furthermore, the front surface of the evaporator 200 may be located to be adjacent to the adjacent protrusion part 521 (or the insulating member of the rear surface of the second part 520) formed at the second part 520, and the rear surface of the evaporator 200 may be located to be adjacent to the inner casing 120, so cold air which passes through the evaporator 200 may not be deviated to the outside of the evaporator 200 while passing through the evaporator 200, but may efficiently flow through the evaporator 200 to the upper end thereof.

Accordingly, the cold air may flow evenly across the entire portion of the evaporator 200, and may sufficiently be heat-exchanged while flowing from the lower end of the evaporator 200 to the upper end thereof, so the maximum heat exchange efficiency of the evaporator 200 may be realized.

Particularly, the blower fan assembly 300 may be located directly above the evaporator 200, and a portion at which the cold air introduction hole 311*a* of the fan housing 310 is located may be located between the front surface and rear surface of the evaporator 200, so cold air passing through the evaporator 200 may be prevented from hitting the circumferential surface of the lower end of the fan housing 310, and may flow toward the inner wall surface (the rear surface) of the first duct assembly 400.

Furthermore, the cold air flowing upward on the second part 520 of the second duct assembly 500 located at the front of the cold air introduction hole 311*a* may flow such that the flowing direction of the cold air is gradually inclined rearward by the guidance of the first part 510 of the second duct assembly 500, and may efficiently flow toward the cold air introduction hole 311*a*.

Next, cold air introduced into the blower fan assembly 300 (more specifically, the fan housing) through the cold air introduction hole 311*a* after passing through the evaporator 200 may pass through the cold air exit hole 315 located in a direction perpendicular to the cold air introduction hole 311*a*, and may be supplied into the cold air flow path 421 of the first duct assembly 400.

In addition, the cold air introduced into the cold air flow path 421 may flow upward by the guidance of the cold air flow path 421. In this process, some portion of the cold air may pass through each of the communication holes 422 formed in the cold air flow path 421 and may pass through the cold air discharge holes 411 corresponding to the communication holes 422, and may be supplied to each space inside the storage compartment.

In addition, the remaining portion of the cold air flowing upward along the cold air flow path 421 may be discharged to the upper discharge tube 412 provided at the upper end of the cold air flow path 421 and the upper discharge part 413 located at each of the opposite sides of the upper discharge tube 412.

In this case, cold air discharged through the upper discharge tube 412 may be guided by the front guide duct 440 and be supplied to the inside of the storage compartment from the upper surface at a front side inside the storage compartment.

In addition, the cold air discharged to the upper discharge part 413 may be efficiently discharged toward the inside of the storage compartment located at the front of the upper discharge part 413 by the guidance of the round upper surface of the upper discharge part 413.

In addition, the cold air supplied into the storage compartment may cool goods stored inside the storage compartment, and may pass through the introduction duct 540 of the second duct assembly 500 due to blowing force caused by the rotation of the blower fan 320, and may be introduced to the cold air introduction side of the evaporator 200. Accordingly, this circulation of the cold air may repeat.

Finally, due to the repetition of the cold air circulation described above, the inside of the storage compartment may constantly be maintained at constant temperature.

As described above, in the refrigerator of the present disclosure, the cold air introduction hole of the blower fan assembly 300 may be located behind the front surface of the evaporator 200, so cold air may be efficiently introduced into the blower fan assembly 300 through the evaporator 200 without the rapid change of the flowing direction of the cold air.

Accordingly, the flow resistance of the cold air may be reduced, so noise caused by the flow resistance may be prevented and consumption efficiency may be improved.

Particularly, in the refrigerator of the present disclosure, the cold air introduction hole of the blower fan assembly 300 may be configured to be located between the front surface and rear surface of the evaporator 200, the flow resistance of cold air may be reduced.

In addition, in the refrigerator of the present disclosure, the second part 520 of the second duct assembly 500 may be configured to block the entire portion of the front surface of the evaporator 200, so cold air to pass through the evaporator 200 may sufficiently pass through the evaporator 200, and thus the heat exchange efficiency of the evaporator 200 may be improved.

Furthermore, in the refrigerator of the present disclosure, the second duct assembly 500 may be configured to be coupled to or decoupled from the first duct assembly 400 by bending, so the removal of the second duct assembly from the first duct assembly and the maintenance of the blower fan assembly 300 and the evaporator 200 may be facilitated.

Additionally, in the refrigerator of the present disclosure, a machine room 150 may be configured to be located at the lower portion of a rear side inside the cabinet 100, so the entire height of the refrigerator may be decreased and more storage space than a refrigerator having the same height may be secured.

Furthermore, in the refrigerator of the present disclosure, the bent portion of the second duct assembly 500 may be located to be adjacent to a portion through which cold air is introduced into the blower fan assembly 300, so the flow of the cold air passing through the evaporator 200 to the cold air introduction hole of the blower fan assembly 300 may be facilitated.

Additionally, in the refrigerator of the present disclosure, the filtering member 541 may be provided in the introduction duct 540, so foreign matter contained in cold air flowing to the evaporator 200 may be filtered.

What is claimed is:

1. A refrigerator comprising:

a cabinet that defines a storage compartment;

an evaporator located inside the cabinet;

a blower fan assembly located above the evaporator and configured to generate a flow of cold air passing through the evaporator;

a first duct assembly located in the cabinet and configured to guide the cold air from the blower fan assembly to the storage compartment; and a second duct assembly located below the first duct assembly and configured to guide the cold air passing through the evaporator to the blower fan assembly, wherein the blower fan assembly has (i) a front surface that faces the storage compartment and (ii) a rear surface that faces a rear wall of the cabinet, wherein the front surface of the blower fan assembly defines a cold air introduction hole that is located rearward relative to a front surface of the evaporator and forward relative to a rear surface of the evaporator to thereby generate the flow of cold air through the cold air introduction hole in a direction from the front surface of the blower fan assembly toward the rear wall of the cabinet, wherein the blower fan assembly comprises:

a fan housing comprising (i) a front housing that is coupled to a lower end of the first duct assembly and (ii) a rear housing that is coupled to the front housing and extends in a vertical direction along the first duct assembly, wherein an upper portion of the front housing is in contact with and coupled to the lower end of the first duct assembly and inclined forward with respect to the rear housing, and a blower fan located between the front housing and the rear housing, wherein a lower surface of the front housing defines a condensate water discharge hole at a position below the blower fan and above the evaporator, wherein a rear surface of the rear housing protrudes rearward relative to the rear surface of the evaporator toward the rear wall of the cabinet, and wherein the cold air introduction hole is defined at a front surface of the front housing, the front surface of the front housing being located rearward relative to the front surface of the evaporator and forward relative to the rear surface of the evaporator.

2. The refrigerator of claim 1, wherein the second duct assembly is coupled to the lower end of the first duct assembly.

3. The refrigerator of claim 1, wherein the first duct assembly comprises a support that protrudes from the lower end of the first duct assembly, and wherein an upper end of the second duct assembly is mounted to a front surface of the support.

4. The refrigerator of claim 1, wherein the first duct assembly defines a receiving groove at the lower end thereof, and wherein the second duct assembly comprises a receiving protrusion located at an upper end thereof and received in the receiving groove.

5. The refrigerator of claim 1, wherein the second duct assembly covers a front side of the blower fan assembly.

6. The refrigerator of claim 1, wherein the second duct assembly covers both a front side of the blower fan assembly and a front side of the evaporator.

7. The refrigerator of claim 1, wherein the second duct assembly comprises:

a first part located at a front side of the front housing and inclined forward along the upper portion of the front housing, the first part extending toward the lower end of the first duct assembly; and a second part bent from the first part and located at a front side of the evaporator.

8. The refrigerator of claim 7, wherein a boundary between the first part and the second part is located forward relative to the cold air introduction hole.

9. The refrigerator of claim 8, wherein the second duct assembly further comprises a protrusion that protrudes from the second part toward the front surface of the evaporator.

10. The refrigerator of claim 1, wherein the second duct assembly comprises an introduction duct that is located at a lower end of the second duct assembly and that protrudes forward and downward directions, the introduction duct being configured to guide cold air from a bottom of the storage compartment toward the evaporator.

11. The refrigerator of claim 10, wherein the second duct assembly further comprises a filter located at the introduction duct and configured to filter foreign matter in the cold air flowing toward the evaporator.

12. The refrigerator of claim 11, wherein the filter is detachably installed in the introduction duct.

13. The refrigerator of claim 1, wherein the blower fan is fixed to a front surface of the rear housing.

14. The refrigerator of claim 1, wherein the first duct assembly defines a seating groove recessed from the rear surface of the first duct assembly, the seating groove being located at the lower end of the first duct assembly, and wherein the blower fan assembly comprises a seating end located at an upper end of the blower fan assembly and received in the seating groove.

15. The refrigerator of claim 1, wherein the first duct assembly comprises:

a multi duct that defines an entire wall surface of the first duct assembly; and a flow duct that is coupled to a rear surface of the multi duct and defines a cold air flow path therein, the cold air flow path being configured to guide the cold air blown from the blower fan assembly.

16. The refrigerator of claim 15, wherein the cold air flow path of the flow duct includes a lower opening that is oriented downward from a lower end of the flow duct, and wherein the fan housing defines a cold air exit hole at a position corresponding to the lower opening of the cold air flow path, the cold air exit hole being defined at the upper portion of the front housing.

17. The refrigerator of claim 1, wherein the first duct assembly further comprises:

an upper discharge tube located at an upper end of the first duct assembly and configured to discharge the cold air upward, and an upper discharge part located at each of opposite sides of the upper discharge tube and configured to discharge the cold air forward to the storage compartment.

* * * * *